US009342039B2

(12) United States Patent
Eto et al.

(10) Patent No.: US 9,342,039 B2
(45) Date of Patent: May 17, 2016

(54) IMAGE FORMING APPARATUS

(71) Applicant: KYOCERA Document Solutions Inc., Osaka (JP)

(72) Inventors: Daisuke Eto, Osaka (JP); Nobuhiro Fukuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/876,180

(22) Filed: Oct. 6, 2015

(65) Prior Publication Data

US 2016/0103416 A1 Apr. 14, 2016

(30) Foreign Application Priority Data

Oct. 8, 2014 (JP) ..... 2014-207262
Jun. 17, 2015 (JP) ..... 2015-121900

(51) Int. Cl.
*G03G 15/00* (2006.01)
*G03G 21/16* (2006.01)

(52) U.S. Cl.
CPC ..... *G03G 21/1633* (2013.01); *G03G 21/1676* (2013.01)

(58) Field of Classification Search
CPC ..... G03G 21/1633; G03G 21/1676
See application file for complete search history.

(56) References Cited

U.S. PATENT DOCUMENTS 4,967,234 A * 10/1990 Tani ..... G03G 15/0875 399/120
5,862,430 A * 1/1999 Mitekura ..... G03G 15/0126 399/13
6,535,705 B2 * 3/2003 Asakura ..... G03G 15/0126 399/111
7,242,874 B2 * 7/2007 Tsusaka ..... G03G 15/6529 399/111
2008/0286003 A1 * 11/2008 Fukuda ..... G03G 21/1647 399/119
2010/0054814 A1 * 3/2010 Sakurai ..... G03G 15/0865 399/227
2010/0239312 A1 * 9/2010 Kikuchi ..... G03G 21/1821 399/111

FOREIGN PATENT DOCUMENTS

JP 07301992 A * 11/1995
JP 2001-042619 A 2/2001
JP 2002072600 A * 3/2002
JP 2006053475 A * 2/2006
JP 2007-309991 A 11/2007

* cited by examiner

*Primary Examiner* — David Bolduc
(74) *Attorney, Agent, or Firm* — Studebaker & Brackett PC

(57) ABSTRACT

An image forming apparatus includes a cover, a container holder, a detecting unit and a movable member. The cover opens/closes an opening attaching/detaching a toner container. The container holder is supported movably within the opening by attaching the toner container. The detecting unit includes a switching part switching a first position detecting an attaching condition of the toner container and a second position detecting a not-attaching condition of the toner container. The movable member interlocks with an opening/closing operation of the cover and switches the switching part of the detecting unit by moving. The movable member can move in a switching direction of the switching part from the second position to the first position when the cover is closed in the attaching condition. The movable member is restricted from moving in the switching direction by the container holder when the cover is closed in the not-attaching condition.

6 Claims, 23 Drawing Sheets

IMAGE FORMING APPARATUS

INCORPORATION BY REFERENCE

This application is based on and claims the benefit of priority from Japanese Patent application No. 2014-207262 filed on Oct. 8, 2014, and Japanese Patent application No. 2015-121900 filed on Jun. 17, 2015, the entire contents of which are incorporated herein by reference.

BACKGROUND

The present disclosure relates to an image forming apparatus in which a toner container is removably attached.

An electro-photographic image forming apparatus forms an image by visualizing an electrostatic latent image formed on an image carrier by using toner and by transferring the visualized image on a recording sheet. When an amount of the toner reduces to a predetermined amount or less, the toner is replenished from a toner container.

The image forming apparatus is provided with an opening for attaching/detaching the toner container. The opening is openable/closable by a cover. An attachment member removably holing the toner container and electrically connected with the toner container is provided within the opening. When the toner container is electrically connected with the attachment member, various information is transmitted from the toner container. For instance, the toner container is provided with an IC tag storing information, such as a type number and a serial number. When the toner container is attached to the attachment member, radio communication is made between the IC tag and a control part of the image forming apparatus, and various controls are made based on the information stored in the IC tag. If the toner container is removed while electrically connected with the attachment member, there is a possibility that an operation of the image forming apparatus is ill-effected by hot swapping.

Meanwhile, some toner container is provided with a collection part collecting waste toner. If the image forming apparatus is operated without attaching such toner container, there is a possibility that the waste toner clogs and the image carrier causes malfunction.

In order to cope with this problem, there is proposed an image forming apparatus configured such that the toner container is provided with a lever, and such that it becomes possible to detect that the toner container has been attached and to close a cover by turning the lever after attaching the toner container to the toner container attaching part, i.e., such that it is unable to close the cover unless the toner container is attached.

The image forming apparatus as described above is provided with a rib or a projection that interferes with the cover in order to prevent the cover from being closed in a condition in which the toner container is not attached. Therefore, if the cover is erroneously closed in the condition in which the toner container is not attached, there is a possibility that the rib or the projection or a component interfering with the rib and the projection is damaged. Further, if it is configured to be unable to close the door unless the toner container is attached, it becomes hard to convey the image forming apparatus because the cover may be kept opened in a case where it is necessary to convey the image forming apparatus in the condition in which the toner container is not attached for a purpose of maintenance or the like.

It is noted that there is a case when the image forming apparatus is configured so as to detect an opened/closed condition of the cover and to disconnect the electrical connection between the toner container attaching part and the toner container when the cover is opened in order to avoid the hot swapping. That is, although it is necessary to open the cover in order to attach/detach the toner container, the hot swapping may be avoided because the electrical connection is disconnected at the time when the cover is opened.

Thus, it is necessary to detect the opened/closed condition of the cover in order to avoid the hot swapping. It is also necessary to detect whether or not the attachment member is connected with the toner container in order to prevent the malfunction of the image carrier caused by clogging of the waste toner. If these detections are conducted independently, a number of sensors may increase to increase a cost and to complex the controls. Because a full-color image forming apparatus requires a number of toner containers, the number of sensors may increase to increase the cost and to complex of the controls and structure further.

SUMMARY

In accordance with the present disclosure, an image forming apparatus includes a cover, a container holder, a detecting unit and a movable member. The cover opens and closes an opening for attaching/detaching a toner container. The container holder is supported so as to be movable in a predetermined direction within the opening by attaching the toner container. The detecting unit includes a switching part switching a first position detecting an attaching condition of the toner container to the container holder and a second position detecting a not-attaching condition of the toner container to the container holder. The movable member interlocks with an opening/closing operation of the cover and switches the switching part of the detecting unit by moving. The movable member is allowed to move in a direction of switching the switching part from the second position to the first position when the cover is closed in the attaching condition of the toner container to the container holder. The movable member is further configured so that the move in the direction of switching the switching part from the second position to the first position is restricted by the container holder when the cover is closed in the not-attaching condition of the toner container to the container holder.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 15A is a side view illustrating a pressing piece of the cover coming into contact with a pressed part of the second movable member and FIG. 15B is a side view illustrating the pressing piece pushes up the pressed part.

DETAILED DESCRIPTION

In the following, an image forming apparatus of an embodiment of the present disclosure will be described below with reference to the attached drawings.

Figure 1:
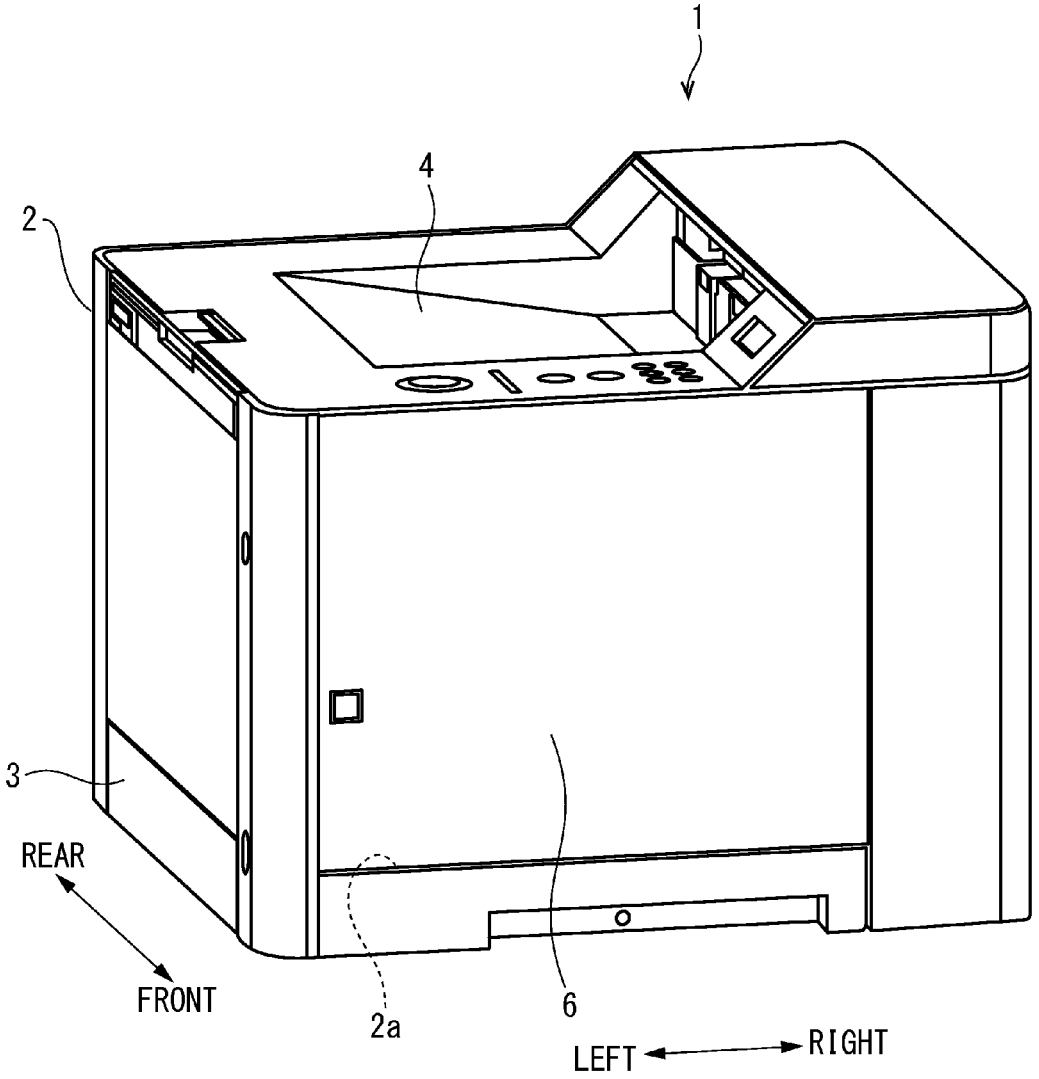
FIG. 1 is a perspective view illustrating a color printer according to an embodiment of the present disclosure.
Figure 2:
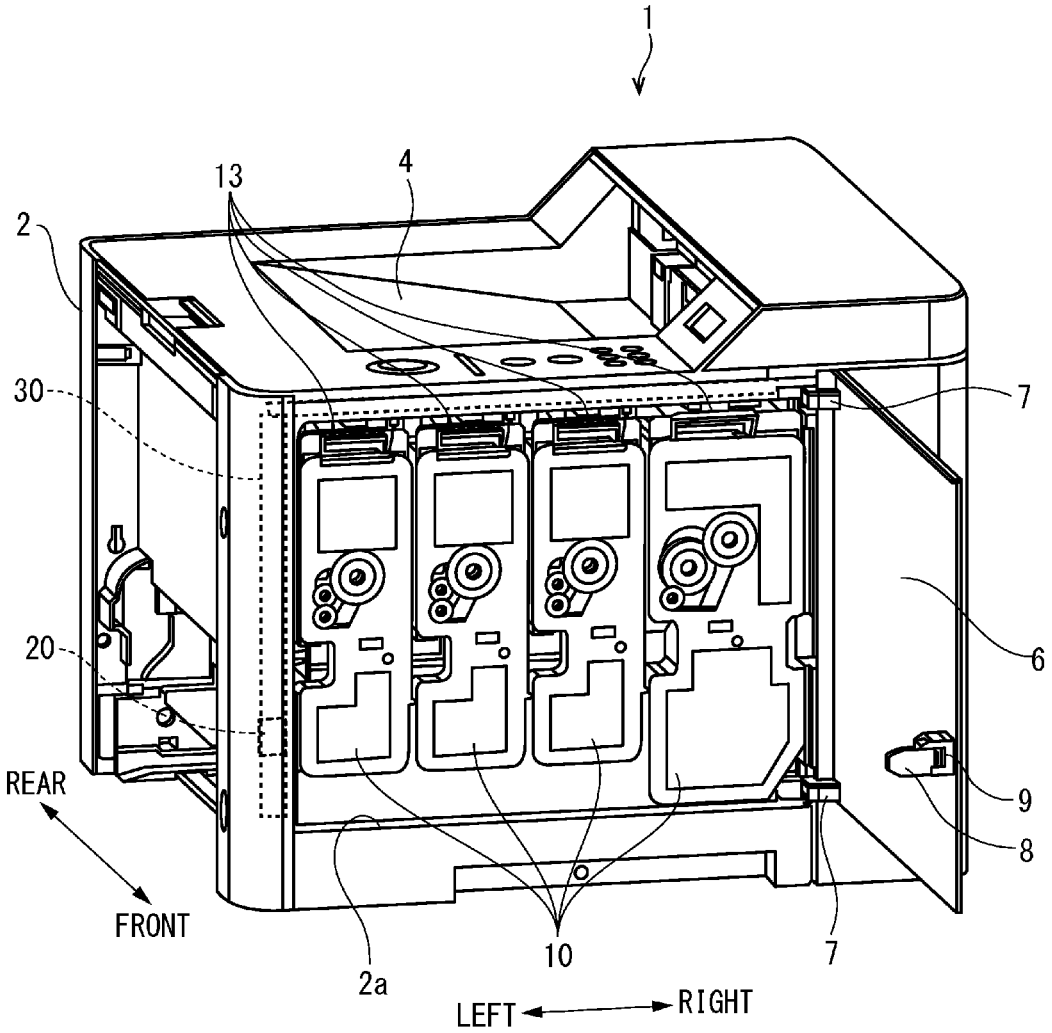
FIG. 2 is a perspective view illustrating the color printer, in a state that a toner container attaching/detaching opening is opened, according to the embodiment of the present disclosure.

An entire configuration of a color printer 1 as an image forming apparatus will be described with reference to FIGS. 1 and 2. FIG. 1 is a perspective view illustrating the color printer 1, and FIG. 2 is a perspective view illustrating a state in which a toner container attaching part is opened by turning a cover of the color printer 1. The following description will be made by assuming that a front side of a sheet surface of FIG. 1 is a front face side (front side) of the color printer 1 and right and left directions are directions viewed from the front face of the color printer 1.

As shown in FIG. 1, the color printer 1 includes an apparatus body 2 formed in a roughly rectangular box shape. A sheet feed cassette 3 is attached at a lower part of the apparatus body 2, and a discharge tray 4 is provided on an upper surface of the apparatus body 2. Further, within the apparatus body 2, an image forming part forming an image in an electrophotographic manner by using four colors of toners, a sheet conveying path directing from the sheet feed cassette 3 to the discharge tray 4 via the image forming part, and a control part controlling an image forming operation are provided. The control part controls such that the sheet is fed from the sheet feed cassette 3, conveyed along the conveying path, and is discharged to the discharge tray 4 after forming an image in the image forming part.

As shown in FIG. 2, a horizontally-long rectangular toner container attaching/detaching opening 2*a* is formed on the front face of the apparatus body 2. The toner container attaching/detaching opening 2*a* can be opened/closed by a cover 6. Further, the apparatus body 2 is provided, within the toner container attaching/detaching opening 2*a*, with container holders 13 in which toner containers 10 containing respective color toners are removably held respectively, a detecting unit 20 switched by detecting whether each toner container 10 is attached or detached to each container holder 13, and a movable member 30 interlocking with the opening/closing operation of the cover 6 and switching the detecting unit 20.

Figure 3:
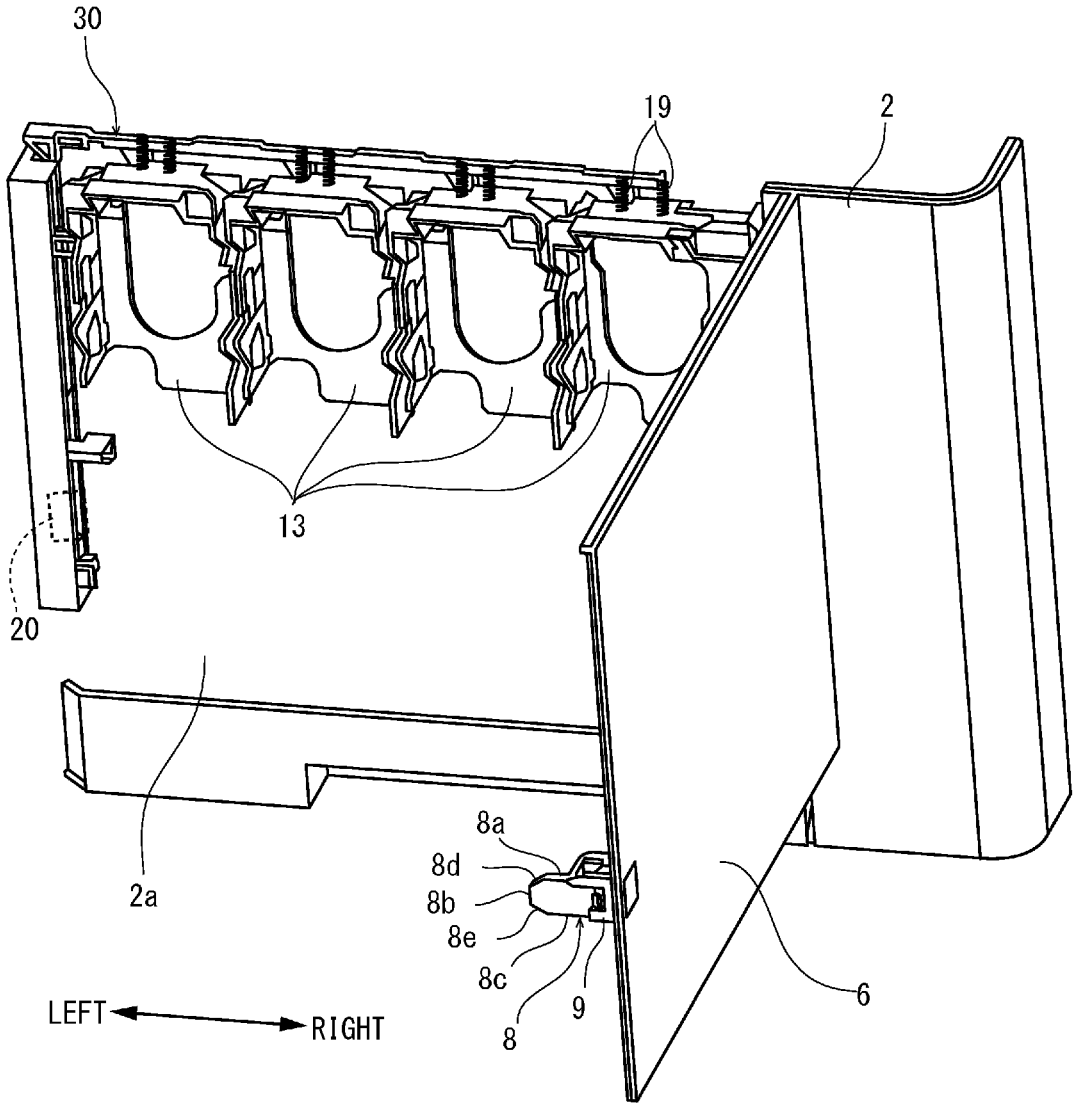
FIG. 3 is a perspective view illustrating a front structure of an apparatus body, viewed from an upper right side, in the color printer according to the embodiment of the present disclosure.
Figure 5A:
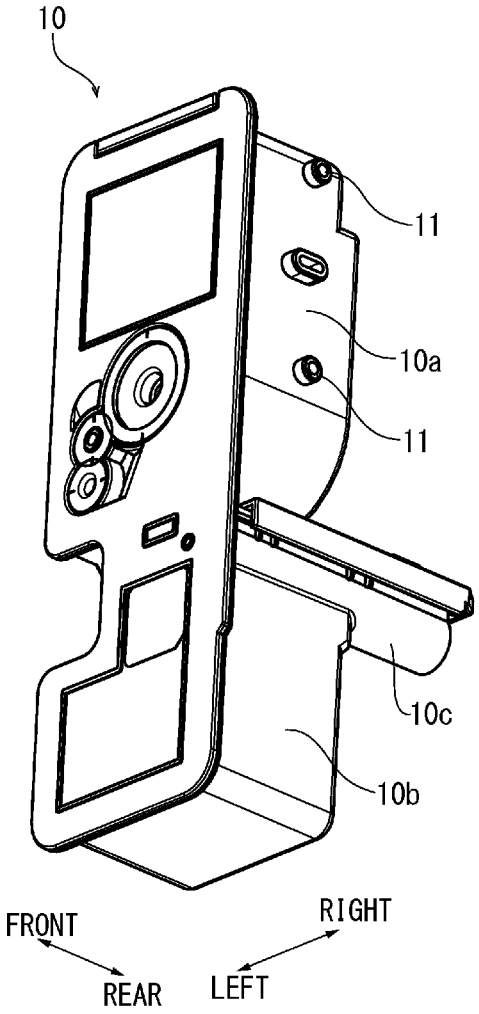
FIG. 5A is a perspective view illustrating a toner container, viewed from a lower right side.
Figure 5B:
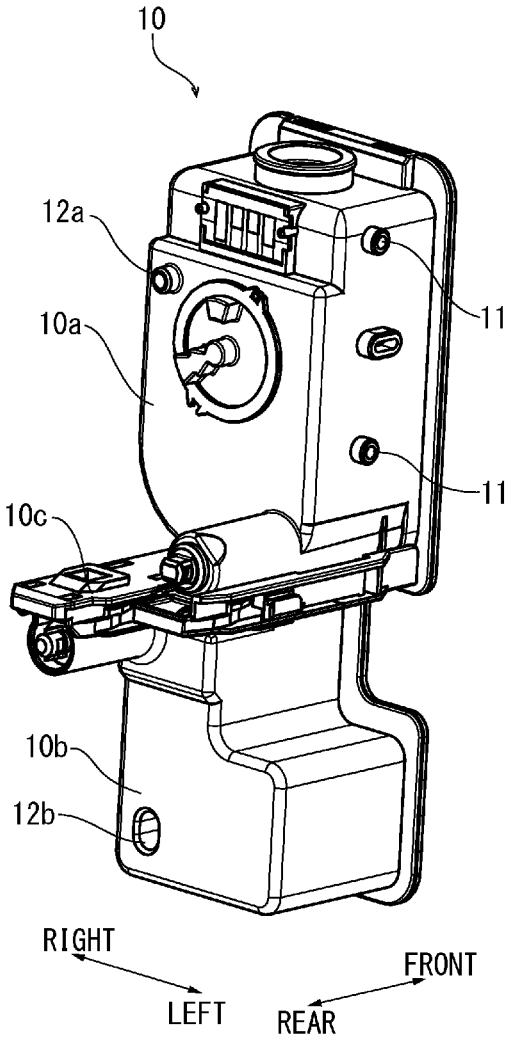
FIG. 5B is a perspective view illustrating the toner container, viewed from a left rear side, in the color printer according to the embodiment of the present disclosure.
Figure 6A:
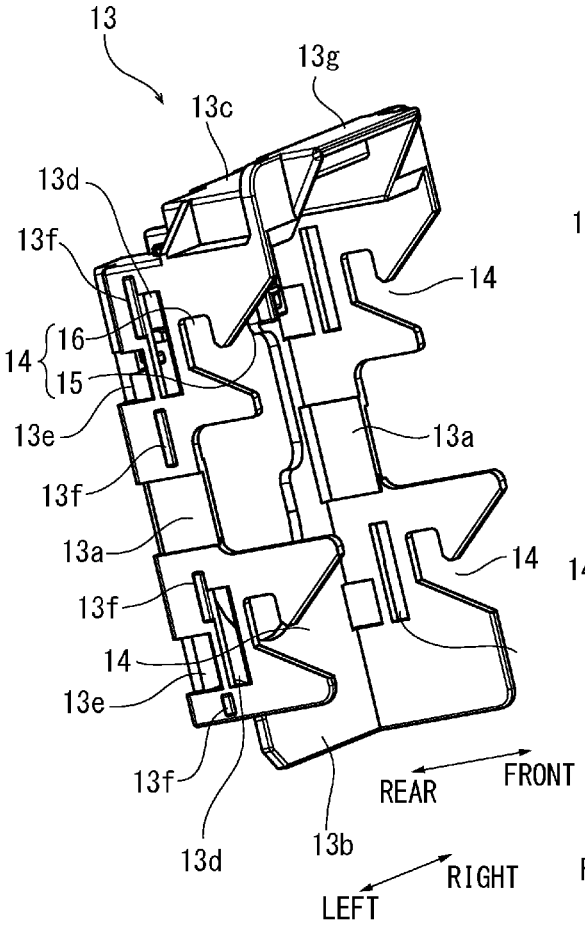
FIG. 6A is a perspective view illustrating a container holder, viewed from the left front side.
Figure 6B:
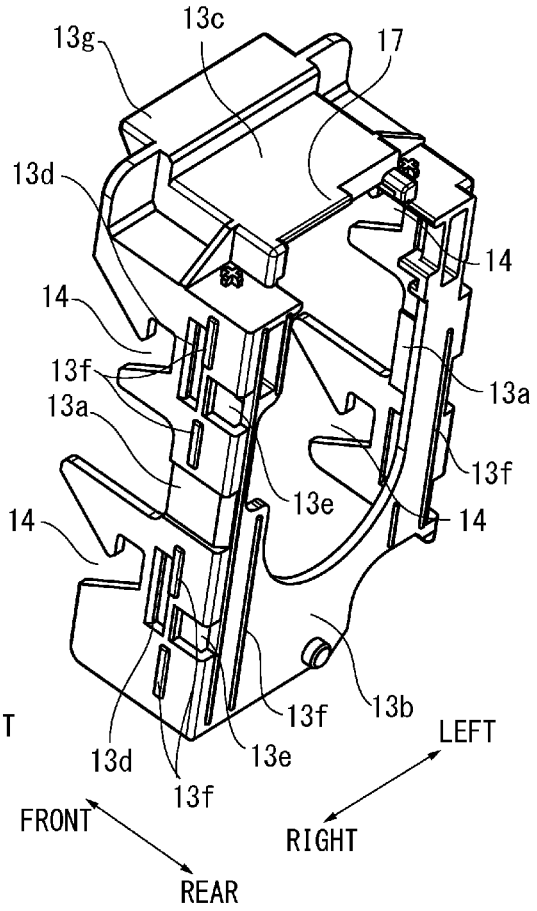
FIG. 6B is a perspective view illustrating the container holder, viewed from a right rear side, in the color printer according to the embodiment of the present disclosure.
Figure 7:
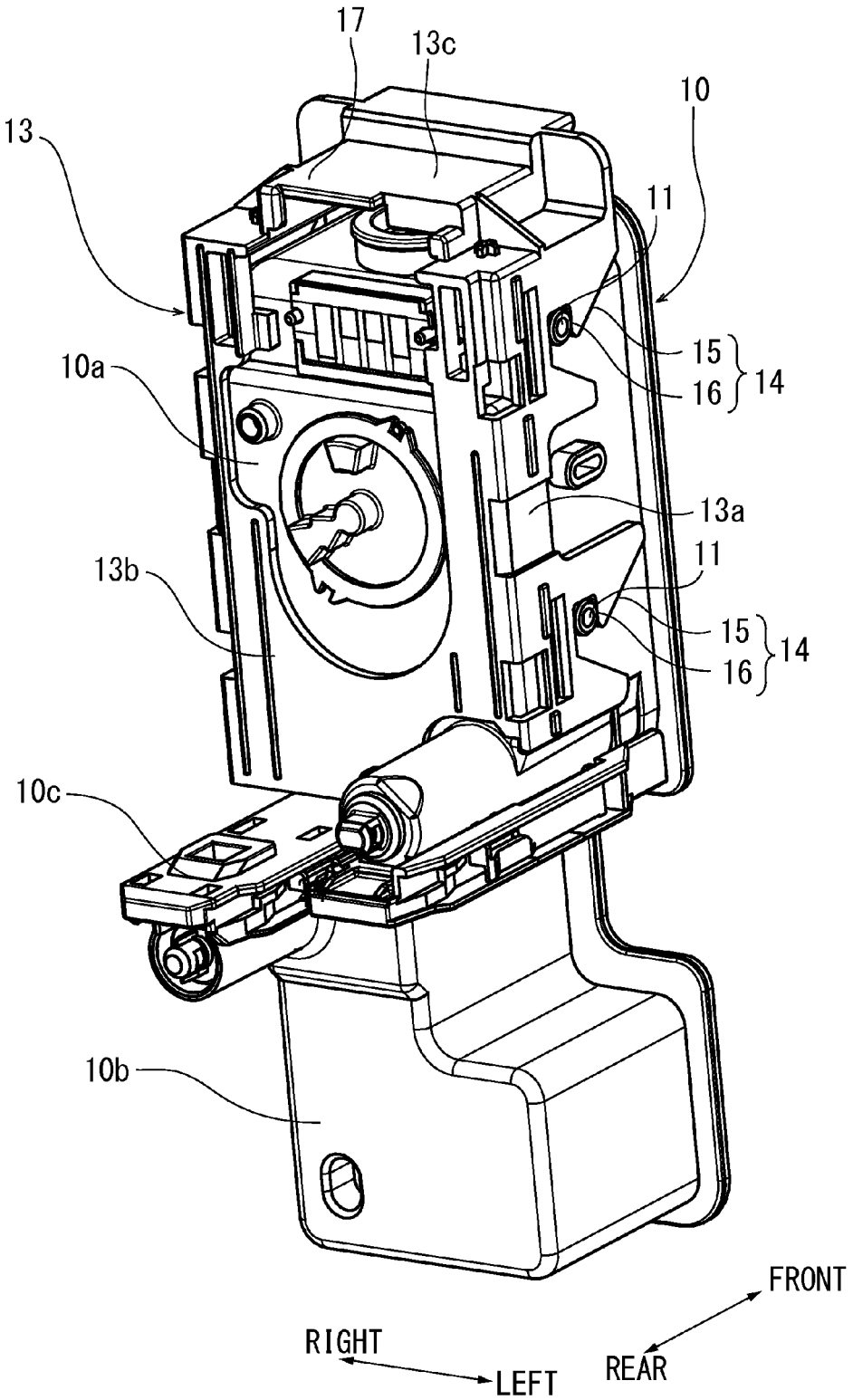
FIG. 7 is a perspective view illustrating the toner container attached to the container holder, viewed from the left rear side, in the color printer according to the embodiment of the present disclosure.
Figure 8:
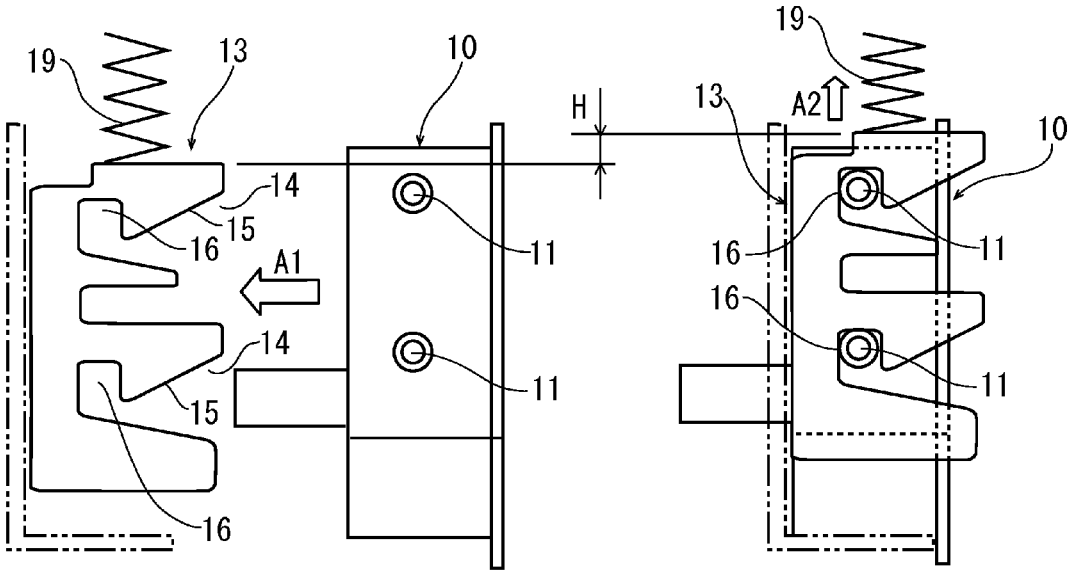
FIG. 8 is a schematic diagram illustrating the container holder moved in attaching to the toner container in the color printer according to the embodiment of the present disclosure.
Figure 9:
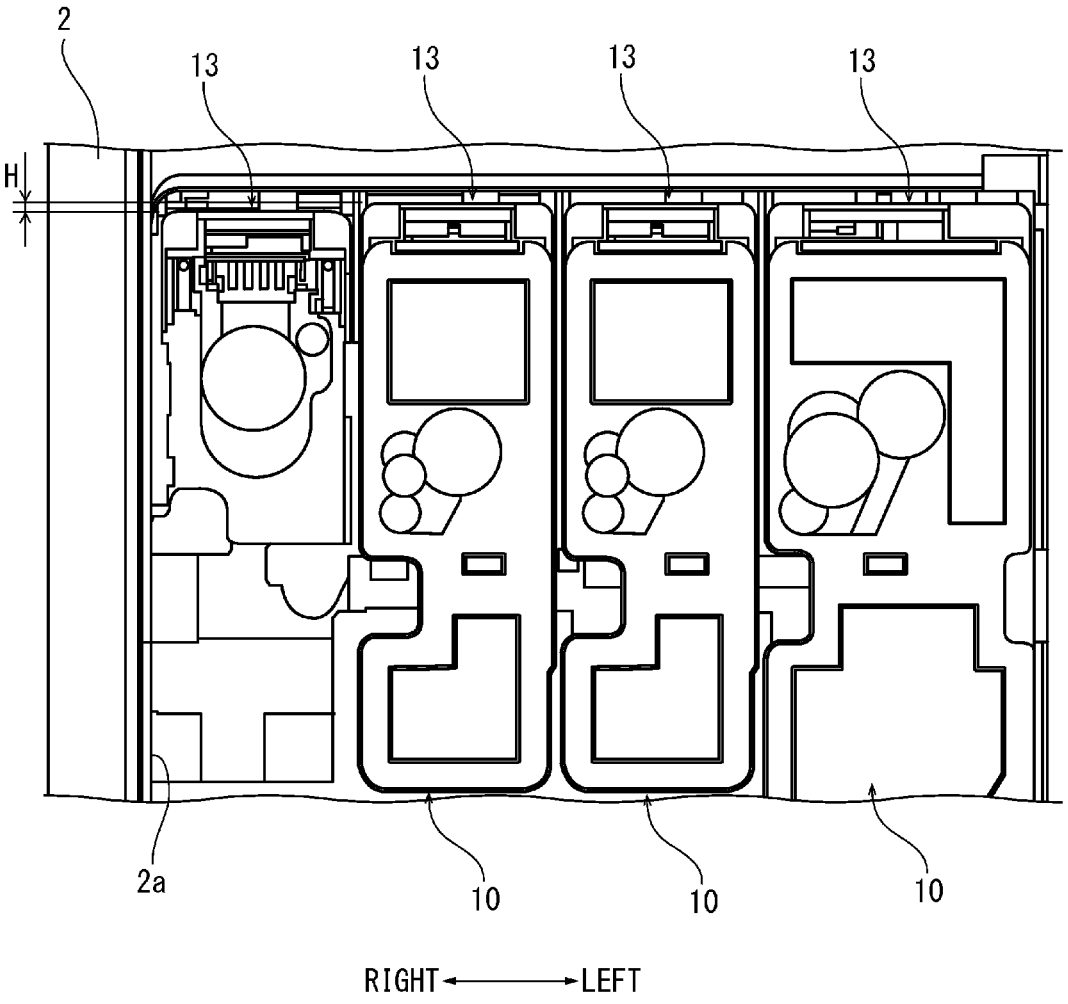
FIG. 9 is a front view illustrating the color printer, in a state that the toner containers are attached to the container holders, according to the embodiment of the present disclosure.

Next, with reference to FIGS. 2-9, a structure of the front face of the apparatus body 2, the toner container 10, and the container holder 13 will be described. FIG. 3 is a perspective view illustrating the front face of the apparatus body viewed obliquely from an upper right side, FIG. 4 is a perspective view illustrating the front face of the apparatus body viewed obliquely from an upper left side, FIGS. 5A and 5B are perspective views illustrating the toner container, FIGS. 6A and 6B are perspective views illustrating the container holder, FIG. 7 is a perspective view illustrating the toner container attached to the container holder, FIG. 8 is a schematic diagram illustrating a move of the container holder in attaching the toner container, and FIG. 9 is a front view illustrating a state in which the toner container is attached to the container holder.

Figure 4:
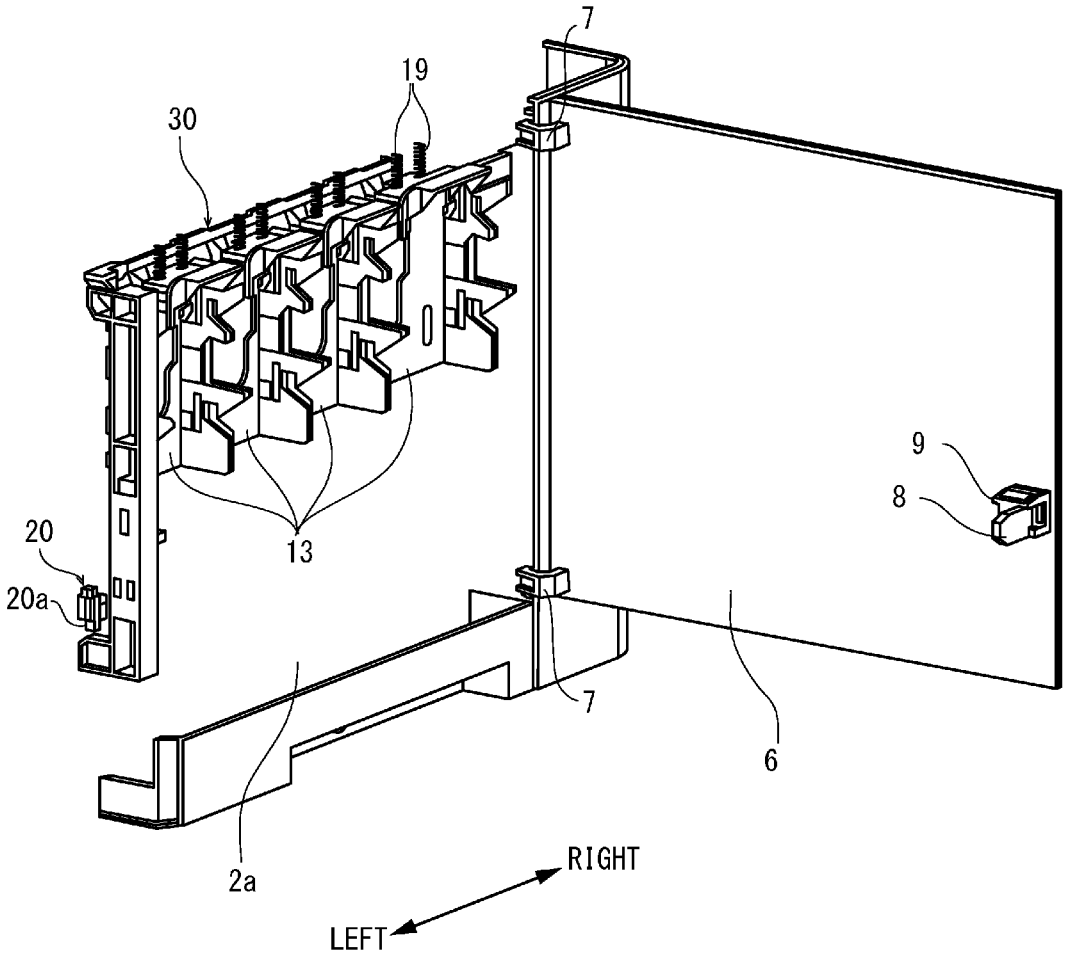
FIG. 4 is a perspective view illustrating the front structure of the apparatus body, viewed from a left front side, in the color printer according to the embodiment of the present disclosure.

As shown in FIGS. 2 and 4, the apparatus body 2 is provided with a pair of upper and lower turning shafts 7 at upper right and lower right corners of the toner container attaching/detaching opening 2*a*. The cover 6 is supported by the turning shafts 7 so as to be turnable at degrees or more to open/close the toner container attaching/detaching opening 2*a*. On an inside face of the cover 6, at a slightly inner side of its left edge, a pressing piece 8 is fixed and supported by a bracket 9. The pressing piece 8 is a formed into a rectangular parallelepiped shape thin in left and right directions and, as shown in FIG. 3, tapered faces 8*d* and 8*e* are formed respectively at a corner between an upper face 8*a* and a rear face 8*b* and at a corner between a lower face 8*c* and the rear face 8*b*.

Within the toner container attaching/detaching opening 2*a*, in the apparatus body 2, guide members (not shown) supporting respective container holders 13 with movable in upward and downward directions (predetermined direction) are arrayed in the left and right directions. Each guide member has a flat surface facing the toner container attaching/detaching opening 2*a* and extending roughly orthogonal to the upward and downward directions. At one part of the flat surface, an opening communicating with the image forming part is formed. Further, a positioning hole and a positioning boss are formed side by side on a vertical line at upper and lower parts of the flat surface. Further, on right and left edges of the flat surface, partition walls erecting orthogonal to a forward direction and extending orthogonal to the upward and downward directions are formed respectively. At front end parts of surfaces of the partition walls facing with each other, two fitting projections projecting inwardly are formed side by side in the upward and downward directions.

Below each guide member, a holding part projecting forward horizontally is formed. The toner container 10 is temporarily placed on the holding part when it is attached to the container holder 13.

As shown in FIGS. 5A and 5B, the toner container 10 is formed in a vertically-long roughly parallelepiped shape and includes a toner containing part 10*a* located at its upper part to contain toner to be supplied to the image forming part, a toner collection part 10*b* located at its lower part to collect waste toner, and a link part 10*c* located between the toner containing part 10*a* and the toner collection part 10*b* and linked with the image forming part. On a rear surface of the toner containing part 10*a*, a toner replenishing port is provided to supply the toner from the toner replenishing port to the image forming part. Further, the toner containing part 10*a* is provided with bosses 11 projecting in the left and right directions on its right and left side surfaces at two spots distant in the upward and downward directions. To the toner collection part 10*b*, the waste toner caused in the image forming part is collected through the link part 10*c*.

The toner containing part 10*a* is also provided with a positioning boss 12*a* projecting backwardly on its rear surface and the toner collection part 10*b* is provided with a vertically-long longhole-like positioning concave part 12*b* on its rear surface. The positioning boss 12*a* and the positioning concave portion 12*b* are disposed on a vertical line. The toner container 10 is positioned with respect to the guide member by respectively fitting the positioning boss 12*a* and the positioning concave portion 12*b* with the positioning hole and the positioning boss formed on the flat part of the guide member.

As shown in FIGS. 6A and 6B, the container holder 13 is composed of right and left side plates 13*a* facing with each other, a rear plate 13*b* and an upper plate 13*c* consisting a rectangular parallelepiped concave portion whose front and lower surfaces are opened. The right and left side plates 13*a* are provided with notches 14 arrayed in the upward and downward directions along front edges. Each notch 14 includes an inclined edge 15 inclined in an obliquely lower direction from a rear edge and an engagement part 16 continued from a rear edge of the inclined edge 15 and concaved upwardly. Further, the rear plate 13*b* is provided with a roughly elliptic opening. The upper plate 13*c* is also provided with a restricting piece 17 (see FIG. 6B) extending backwardly from a nearly right half of the rear edge.

Further, the right and left side plates 13*a* of the container holder 13 are provided with two vertically-long rectangular slide holes 13*d* being distant in the upward and downward directions. Further, the right and left side plates 13*a* are provided with rectangular attachment openings 13*e* extending from the rear plate 13*b* toward lower halves of respective slide holes 13*d*. Further, a plurality of ribs 13*f* extending in the upward and downward directions are formed on outer surfaces of the right and left side plates 13*a* and of the rear plate 13*b*. The rib 13*f* is also formed along a rear edge of an upper half of each slide hole 13*d*. Further, a plate-like grip 13*g* projecting forward is formed at a front edge part of the upper plate 13*c*.

A method for attaching the container holder 13 to the guide member will be described. The container holder 13 is pushed into the guide member from the front side while positioning each attachment opening 13*e* form in each side plate 13*a* with the fitting projection erected on each partition wall of the guide member. Since each fitting projection moves within the attachment opening 13*e*, the container holder 13 is pushed into the guide member without interfering with each side plate 13*a*. After when the fitting projection is locked by a front edge of the attachment opening 13*e*, the container holder 13 is pushed further. Because a part between the attachment opening 13*e* and the slide hole 13*d* is formed into a upwardly/downwardly-long shape with a narrow width which is elastically deformable, this part is elastically deformed and each fitting projection is fitted into each slide hole 13*d* by pushing the container holder 13. It is noted that the fitting projection has a size fitting movably in the upward and downward directions within the slide hole 13*d*.

As shown in FIGS. 3 and 4, the respective container holders 13 are arrayed in the left and right directions inside an upper part of the toner container attaching/detaching opening 2*a*. Each container holder 13 is biased downwardly by two springs 19 and supported so as to move upwardly against bias force of the springs 19 by attaching the toner container 10. It is noted when the container holder 13 slides in the upward and downward directions with respect to the guide member, each fitting projection of the guide member moves at an upper part of each slide hole 13*d* in the upward and downward directions. Because the rib 13*f* is formed along the rear edge at the upper part of each slide hole 13*d*, when each fitting projection interferes with a rear side surface of the slide hole 13*d* and the rib 13*f*, the container holder 13 is restricted from moving forwardly. Further, because the right and left side plates 13*a* and the rib 13*f* formed on the rear plate 13*b* of the container holder 13 come into contact with the inner surface of each partition wall and the flat surface of the guide member, a friction force between the container holder 13 and the guide member is reduced and the container holder 13 can smoothly slide in the upward and downward directions. It is also possible to manually move the container holder 13 upwardly against the bias force of the springs 19 by holding the grip 13*g*.

As shown in FIG. 7, the toner container 10 is attached to the corresponding container holder 13. In attaching the toner container 10 to the container holder 13, a lower surface of the toner container 10 is placed on the holding part and is pushed backwardly. Then, the positioning boss 12*a* and the toner replenishing port provided on the rear surface of the toner containing part 10*a* are exposed out of the opening formed on the rear plate 13*b* of the container holder 13. Then, the positioning boss 12*a* and the positioning concave portion 12*b* of the toner container 10 are fitted respectively into the positioning hole and the positioning boss formed on the flat surface of the guide member. This arrangement makes it possible to position the toner container 10 in the upward and downward directions and the left and right directions with respect to the guide member.

At this time, in the container holder 13, if the toner container 10 is fitted into the concave part of the container holder 13 as shown in the left diagram in FIG. 8 (see a white blanked arrow A1 in FIG. 8), each boss 11 erected on each of the right and left side surfaces of the toner containing part 10*a* enters into each notch 14 formed on the right and left side plates 13*a* of the container holder 13 while being pushed down along each inclined edge 15 and engages with each engagement part 16. Thus, the toner container 10 is restricted from moving forwardly. Further, as shown in the right diagram in FIG. 8, because each engagement part 16 is located under each boss 11 of the toner container 10, each engagement part 16 is pushed up by each boss 11 (see a white blanked arrow A2 in FIG. 8), and the container holder 13 moves upwardly by a height H against the bias force of the springs 19.

If the toner containers 10 are thus attached to three right container holders 13 as shown in FIG. 9, these container holders 13 are moved upwardly by the predetermined height H higher than the left container holder 13 to which the toner container 10 is not yet attached.

As shown in FIGS. 3 and 4, the detecting unit 20 is provided slightly above an under left corner of the toner container attaching/detaching opening 2*a*.

The detecting unit 20 is, for example, a push-type sensor and includes, as shown in FIG. 4, a switching part 20*a* projecting downwardly. The switching part 20*a* is configured such that it can be pushed in by applying a predetermined load and it returns to free position when the push is released. The detecting unit 20 can switch between a first position detecting an attaching condition of the toner container 10 to the container holder 13 and a second position detecting a not-attaching condition of the toner container 10 to the container holder 13 by the push and the release of the push of the switching part 20*a*. Specifically, the position is switched to the first position when the switching part 20*a* is pushed in and is switched to the second position when the push is released. The detecting unit 20 is electrically connected with the control part, and if the switching to the first position is transmitted to the control part, the control part determines an image forming enabled state and if switching to the second position is transmitted, the control part determines an image forming disabled state.

As shown in FIGS. 3 and 4, a movable member 30 is a laid L-shaped member and is supported by the apparatus body 2 so as to run along the upper edge and the left edge of the toner container attaching/detaching opening 2*a*.

Figure 10A:
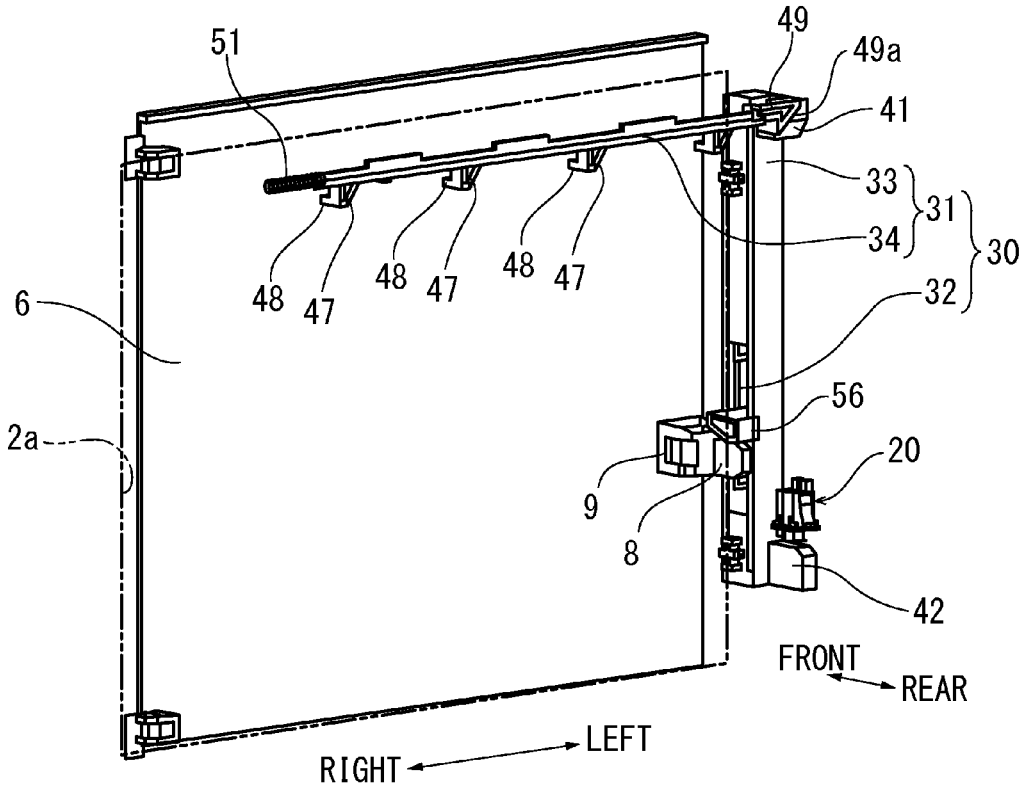
FIG. 10A is a perspective view illustrating a movable member, viewed from the right rear side.

The movable member 30 will be described with reference to FIGS. 10A and 10B and FIGS. 11A and 11B. FIG. 10A is a perspective view illustrating a movable member viewed from the rear side and FIG. 10B is a perspective view illustrating the movable member viewed from the front side, and FIG. 11A is an exploded perspective view illustrating the movable member viewed from the right rear side and FIG. 11B is an exploded perspective view illustrating the movable member viewed from the left front side.

The movable member 30 includes a first movable member 31 sliding the switching part 20*a* of the detecting unit 20 in a direction of switching to the first and second positions and a second movable member 32 slidably supported by the first movable member 31 and interlocking with the opening/closing operation of the cover 6.

Figure 10B:
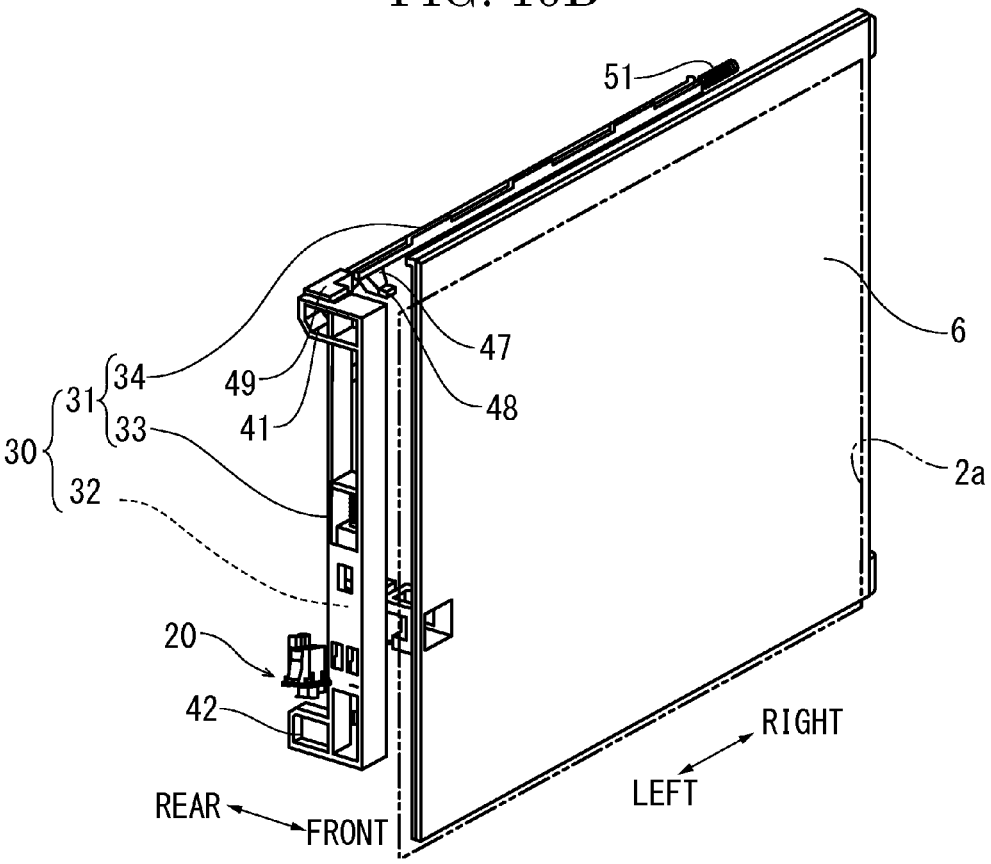
FIG. 10B is a perspective view illustrating the movable member, viewed from the left front side, in the color printer according to the embodiment of the present disclosure.

As shown in FIGS. 10A and 10B, the first movable member 31 includes a vertical sliding member 33 supported slidably in the upward and downward directions along the left edge of the toner container attaching/detaching opening 2*a* and a horizontal sliding member 34 supported slidably in the left and right directions along the upper edge of the toner container attaching/detaching opening 2*a*.

Figure 11A:
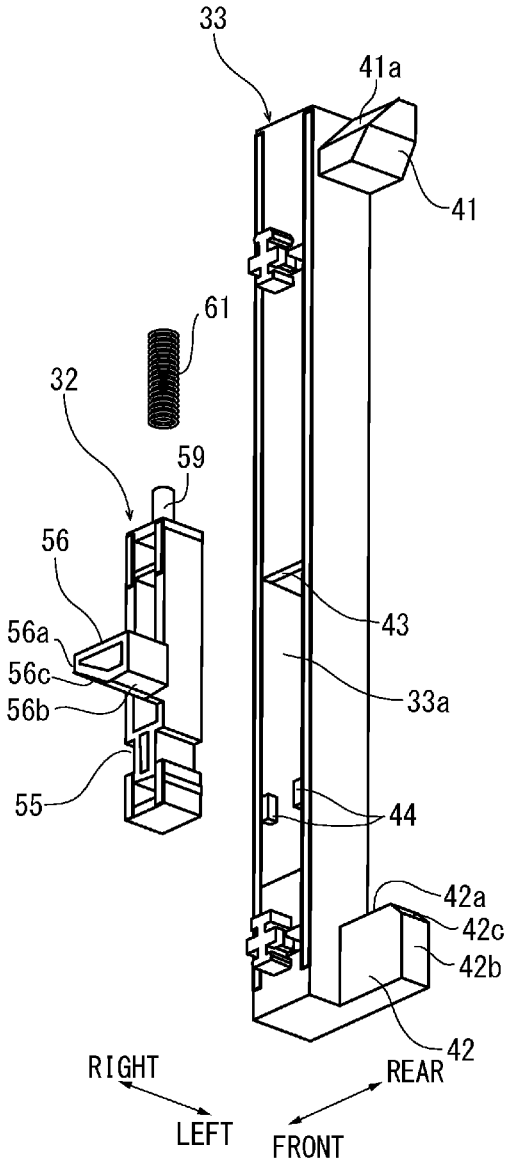
FIG. 11A is an exploded perspective view illustrating a vertical sliding member of the movable member and a second movable member, viewed from the right rear side.
Figure 11B:
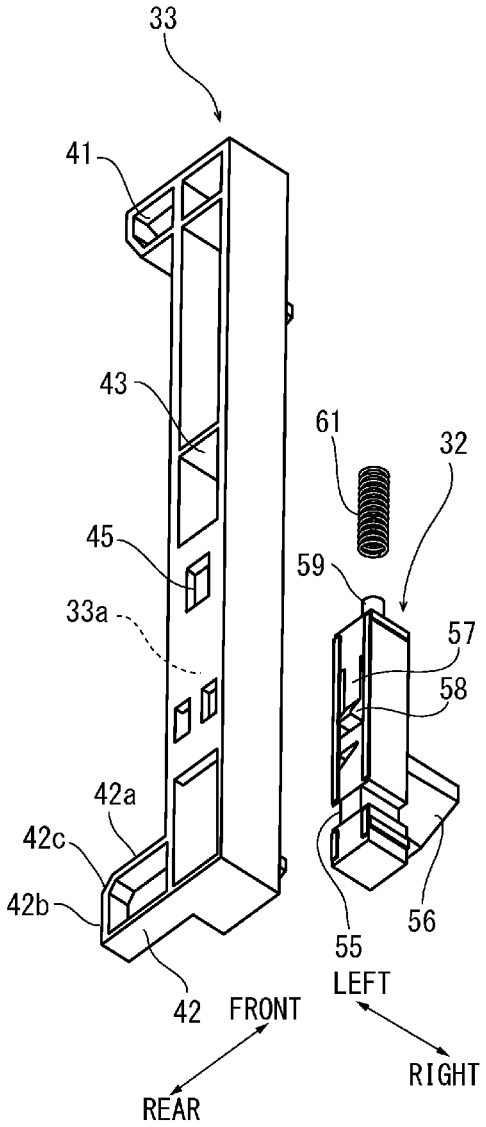
FIG. 11B is an exploded perspective view illustrating the vertical sliding member of the movable member and the second movable member, viewed from the left front side, in the color printer according to the embodiment of the present disclosure.

As shown in FIGS. 11A and 11B, the vertical sliding member 33 is a upwardly/downwardly long hollow square cylindrical member. An upper pressing part 41 pressing the horizontal sliding member 34 is projected on an upper end part of the rear surface of the vertical sliding member 33 and a lower pressing part 42 pressing the switching part 20*a* of the detecting unit 20 is projected on a lower end part of the rear surface of the vertical sliding member 33. In the upper pressing part 41, an inclined face 41*a* run upwardly in an obliquely left direction is formed. The lower pressing part 42 is formed into a parallelepiped shape thin in the left and right directions and provided with a tapered face 42*c* at a corner between an upper surface 42*a* and a rear face 42*b*.

A hollow part of the vertical sliding member 33 is divided vertically by a partition wall 43. A right side surface of a lower hollow part 33*a* is opened and a pair of projecting pieces 44 facing with each other in an inward direction are formed at a slightly lower part from a center of the right side surface. Further, an opening 45 extending in the upward and downward directions is formed at an upper part of a left side surface of the lower hollow part 33*a*.

The vertical sliding member 33 is configured such that an upper surface 42*a* of the lower pressing part 42 is disposed so as to be positioned under the switching part 20*a* of the detecting unit 20 and slide in the upward and downward directions between an upper position where the upper face 42*a* of the lower pressing part 42 pushes in the switching part 20*a* and a lower position where the upper face 42*a* of the lower pressing part 42 separates downwardly from the switching part 20*a* to release the push. That is, the vertical sliding member 33 is configured so as to switch the switching part 20*a* of the detecting unit 20 by sliding in the upward and downward directions.

The horizontal sliding member 34 of the first example is a horizontally-long plate piece as shown in FIGS. 10A and 10B. Project parts 47 corresponding to respective container holders 13 are formed on an underside surface of the horizontal sliding member 34. Locking pieces 48 bent forwardly are formed at lower ends of respective project parts 47. Further, a left pressing part 49 facing the upper pressing part 41 of the vertical sliding member 33 is formed at a left end of the horizontal sliding member 34. The left pressing part 49 is provided with an inclined face 49*a* run downwardly in an obliquely right direction and the inclined face 49*a* faces to the inclined face 41*a* of the upper pressing part 41 of the vertical sliding member 33. That is, the horizontal sliding member 34 is configured such that the horizontal sliding member 34 slides in the left and right directions according to a slide of the vertical sliding member 33 in the upward and downward directions.

The horizontal sliding member 34 is biased in the left direction by a coil spring 51 (second biasing member). Because the horizontal sliding member 34 is thus biased, the inclined face 49*a* of the left pressing part 49 of the horizontal sliding member 34 comes into contact with the inclined face 41*a* of the upper pressing part 41 of the vertical sliding member 33 and the vertical sliding member is biased downwardly. Further, when the horizontal sliding member 34 slides in the left and right directions along the upper edge of the toner container attaching/detaching opening 2*a*, each project part 47 slides along the rear edge of the upper plate 13*c* of the container holder 13 arranged in parallel. In a condition in which the horizontal sliding member 34 is biased in the left direction by the coil spring 51, each project part 47 faces to the rear edge of the upper plate 13*c* on the left side of the corresponding restricting piece 17 of the container holder 13.

As shown in FIGS. 11A and 11B, the second movable member 32 is a square cylindrical member shorter than a height of the lower hollow part 33*a* of the vertical sliding member 33. The second movable member 32 is provided with a narrow part 55 at its lower position with a narrow width in the forward and backward directions. On the second movable member 32, a pressed part 56 to be pressed by the pressing piece 8 provided on the cover 6 is projected at a center on its right side surface. The pressed part 56 is a rectangular parallelepiped member having an obliquely downward inclined face 56*c* at a corner between a front face 56*a* and a lower face 56*b* and configured such that the lower face 56*b* and the inclined face 56*c* are pushed upwardly by the pressing piece 8. Further, on the second movable member 32, an elastic piece 57 elastically deforming with centering on an upper end is formed at an upper part of its left side surface. A tapered claw 58 is formed at an edge on a left face of the elastic piece 57. Further, on an upper face of the second movable member 32, a pin 59 is erected.

The second movable member 32 is stored slidably within the lower hollow part 33*a* of the vertical sliding member 33. When the second movable member 32 is stored in the lower hollow part 33*a*, the narrow part 55 of the second movable member 32 is passed between the pair of projecting pieces 44 and the claw 58 of the elastic piece 57 formed on the left side surface of the second movable member 32 is engaged with the opening 45 of the lower hollow part 33*a*. Thereby, the second movable member 32 slides in the upward and downward directions within the lower hollow part 33*a*. It is noted that the second movable member 32 is prevented from falling out of the lower hollow part 33*a* by the pair of projecting pieces 44.

Within the lower hollow part 33*a*, a coil spring 61 (a first biasing member) idly fitted with the pin 59 is interposed between the second movable member 32 and the partition wall 43. The coil spring 61 biases the second movable member 32 downwardly, i.e., in a direction opposite to a direction (a slide direction of the second movable member 32 interlocking by the closing operation of the cover 6) pushing up the pressed part 56 by the pressing piece 8 of the cover 6. A bias force of the coil spring 61 is set to be greater than the bias force of the coil spring 51 biasing the horizontal sliding member 34.

The operation of switching the detecting unit 20 to the first and second positions by interlocking with the opening/closing operation of the cover 6 by the movable member 30 constructed as described above will be described with reference to FIGS. 12-19.

Figure 12:
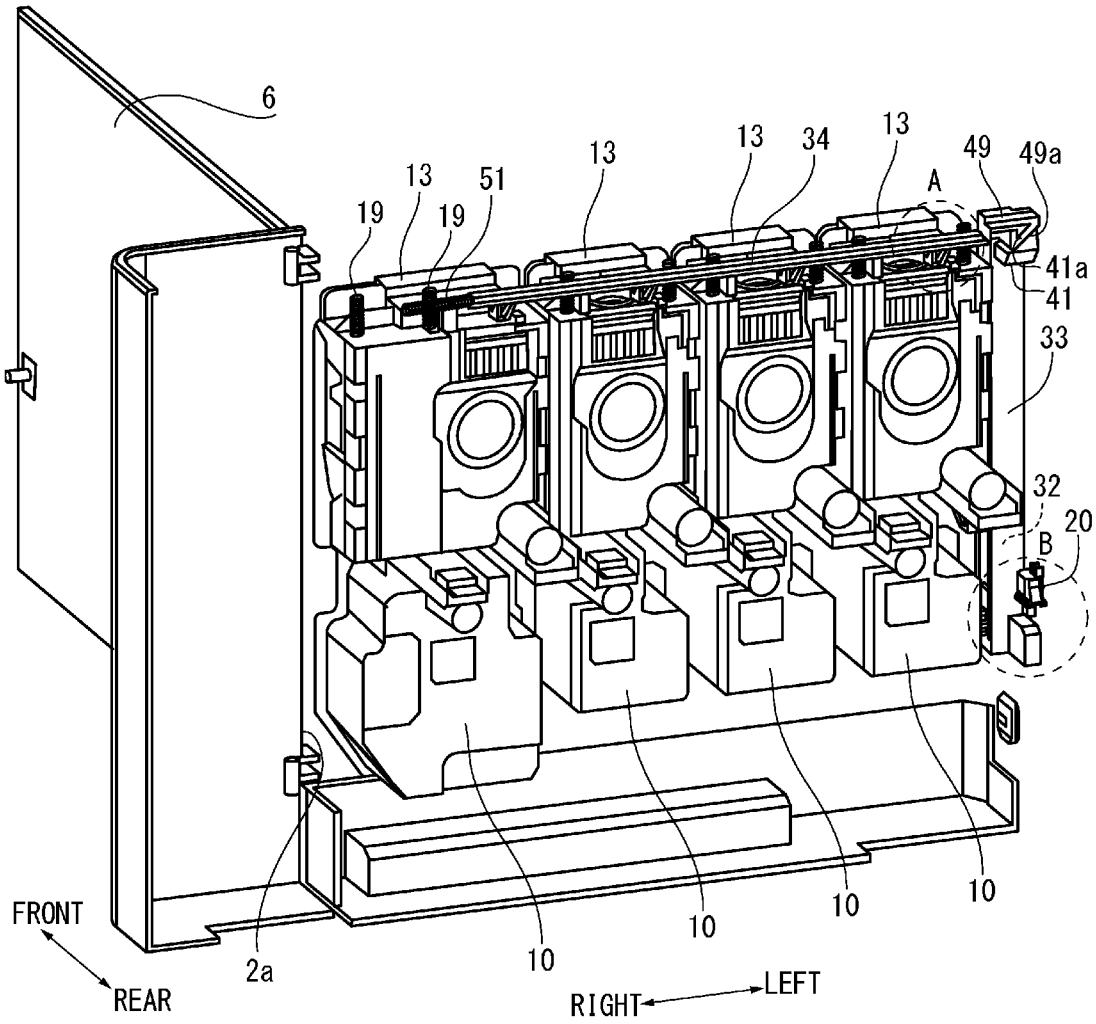
FIG. 12 is a perspective view illustrating the color printer, in a state that the toner containers are attached to all of the container holders and a cover is opened, viewed from the right rear side, according to the embodiment of the present disclosure.

As shown in FIG. 12, in a condition in which all of the toner containers 10 are attached to the container holders 13 and the cover 6 is opened, the horizontal sliding member 34 is biased in the left direction by the coil spring 51, the inclined face 49*a* of the left pressing part 49 presses the inclined face 41*a* of the upper pressing part 41 of the vertical sliding member 33, and the vertical sliding member 33 is biased downwardly. That is, the horizontal sliding member 34 is configured, by being biased in the left and right directions by the coil spring 51, so as to bias the vertical sliding member 33 in the direction switching the switching part 20*a* of the detecting unit 20 from the first position to the second position. In other words, the coil spring 51 is configured so as to bias the first movable member 31 in the direction of switching the switching part 20*a* of the detecting unit 20 from the first position to the second position.

Figure 13A:
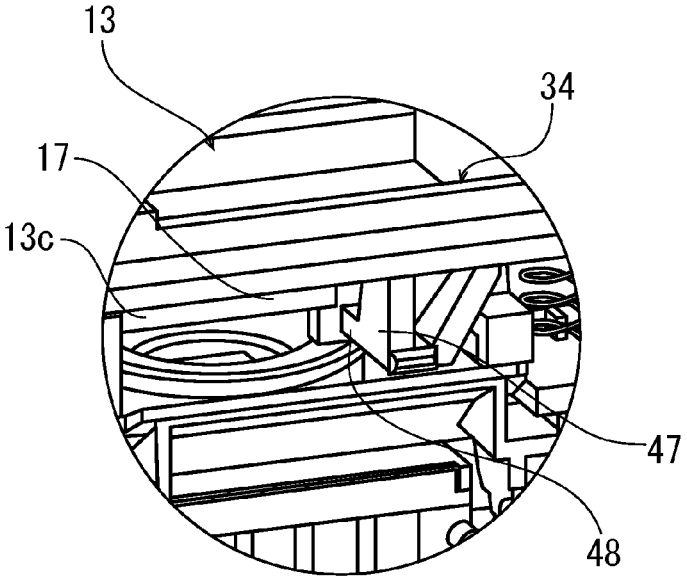
FIG. 13A is an enlarged view of a part A shown in FIG. 12
Figure 13B:
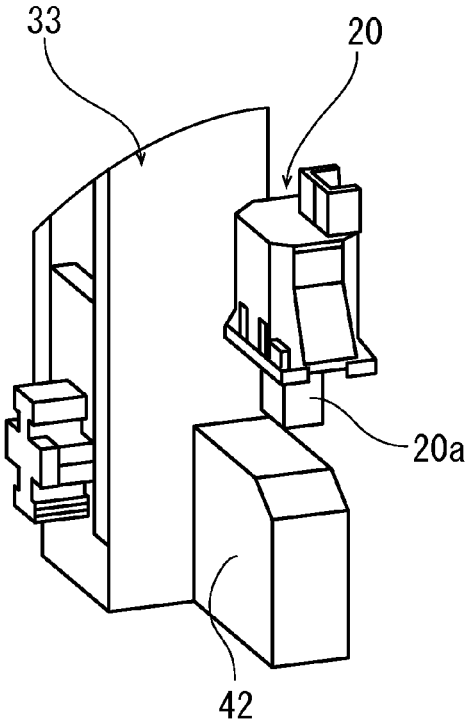
FIG. 13B is an enlarged view of a part B shown in FIG. 12.

Then, as shown in FIG. 13A, the locking piece 48 formed on the project part 47 of the horizontal sliding member 34 is separated downwardly from the restricting piece 17 of the upper plate 13*c* of the container holder 13. Further, as shown in FIG. 13B, the lower pressing part 42 of the vertical sliding member 33 is separated downwardly from the switching part 20*a* of the detecting unit 20 and the push of the switching part 20*a* is released.

Figure 14:
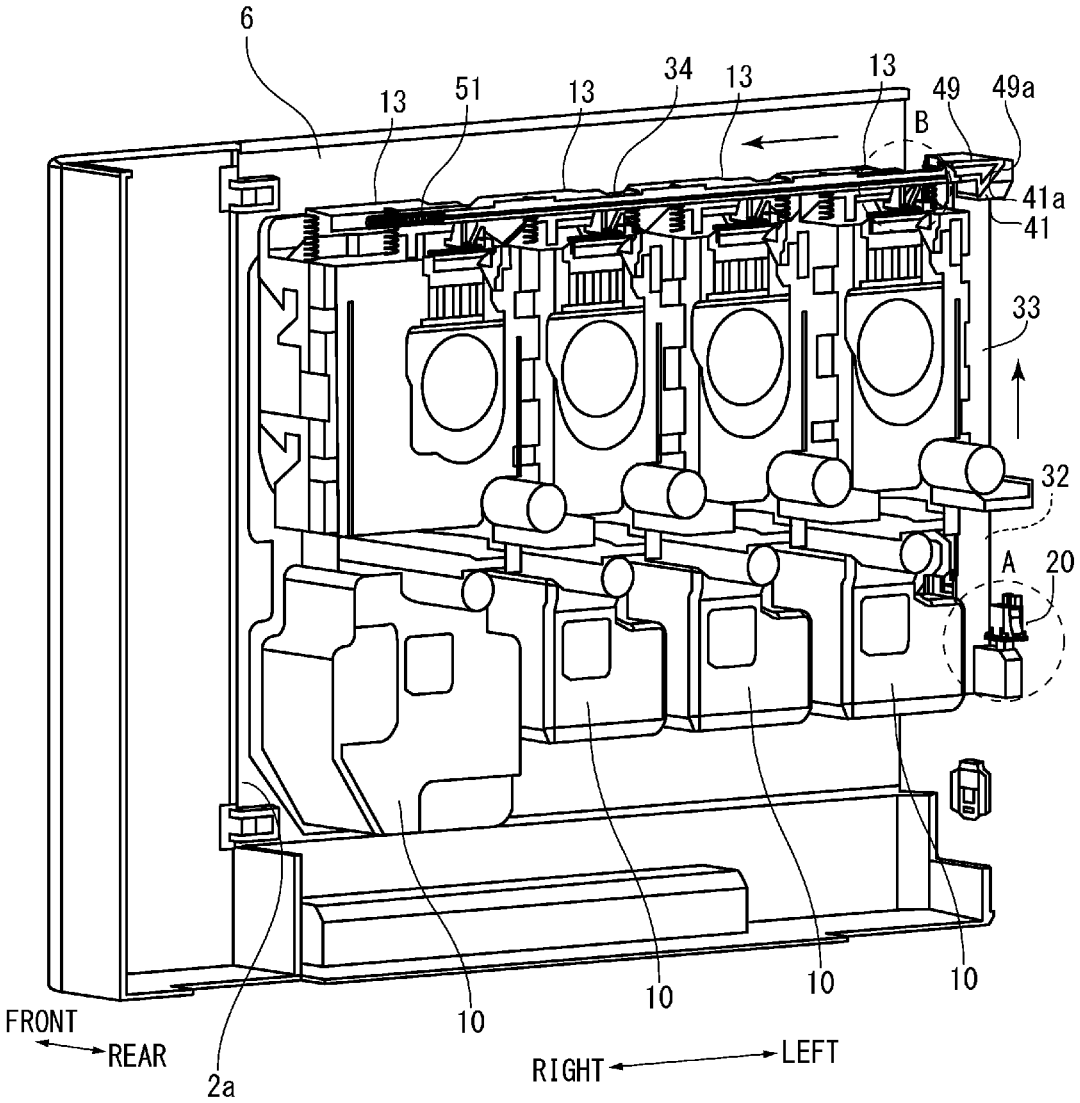
FIG. 14 is a perspective view illustrating the color printer, in a state that the toner containers are attached to all of the container holders and the cover is closed, viewed from the right rear side, according to the embodiment of the present disclosure.
Figure 15A:
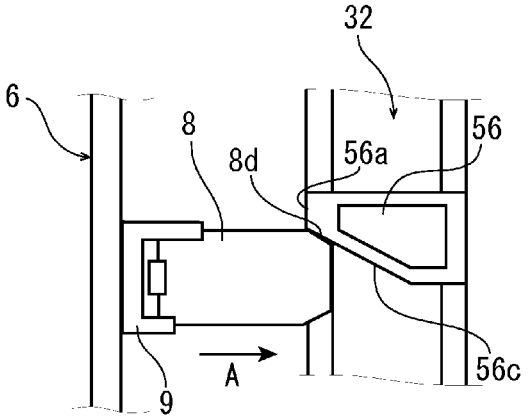
FIG. 15A and FIG. 15B shows an operation of the second movable member interlocking with a cover closing operation in the color printer according to the embodiment of the present disclosure.

When, as shown in FIG. 14, all of the toner containers 10 are attached to the container holders 13 and, as shown in FIG. 15A, the cover 6 is closed (see an arrow A), the pressing piece 8 provided on the cover 6 comes into contact with the pressed part 56 of the second movable member 32 stored in the vertical sliding member 33. More specifically, the tapered face 8*d* of the pressing piece 8 comes into contact with the inclined face 56*c* of the pressed part 56 and the pressed part 56 is pressed upwardly.

When the pressed part 56 of the second movable member 32 is thus pressed upwardly, an upward force is applied to the vertical sliding member 33 in which the second movable member 32 is stored. Then, a force in the right direction is applied to the inclined face 49*a* of the left pressing part 49 of the horizontal sliding member 34 with which the inclined face 41*a* of the upper pressing part 41 of the vertical sliding member 33 comes into contact and a force in the right direction is applied to the horizontal sliding member 34 against the bias force of the upper pressing part 41.

Here, because the bias force of the coil spring 61 biasing the pressed part 56 of the second movable member 32 is greater than the bias force of the coil spring 51 biasing the horizontal sliding member 34 in the left direction, the coil spring 61 biasing the pressed part 56 is not compressed when the pressed part 56 of the second movable member 32 is pressed upwardly by the pressing piece 8 of the cover 6, and the coil spring 51 biasing the horizontal sliding member 34 is preferentially compressed. Accordingly, the horizontal sliding member 34 slides in the right direction and the vertical sliding member 33 slides upwardly together with the second movable member 32 (see an arrow B in FIG. 15B).

Figure 15B:
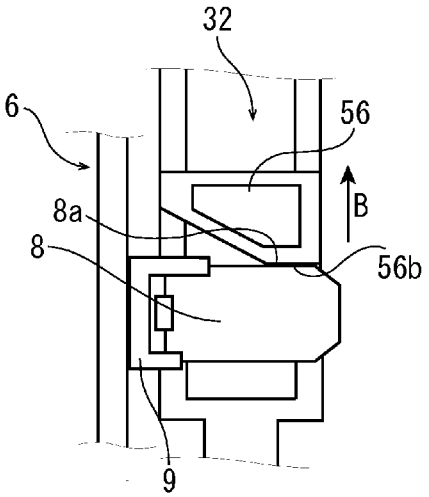
Figure 16A:
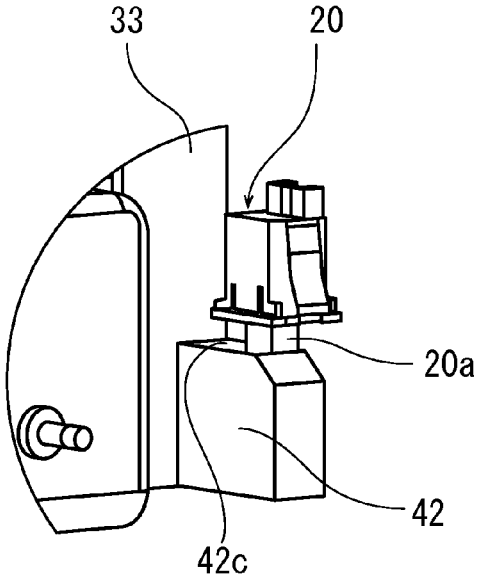
FIG. 16A is an enlarged view of a part A shown in FIG. 14
Figure 16B:
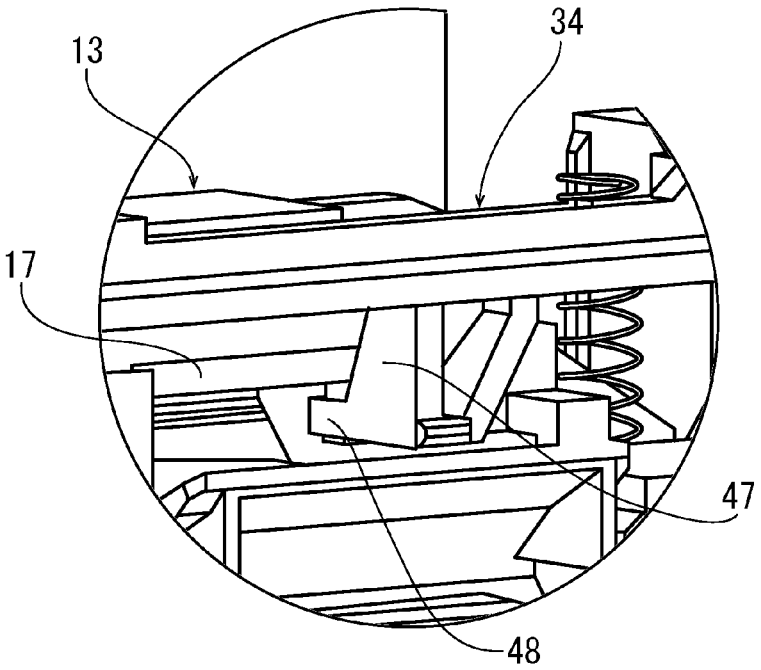
FIG. 16B is an enlarged view of a part B shown in FIG. 14.

Thereby, as shown FIG. 16A, the lower pressing part 42 of the vertical sliding member 33 presses the switching part 20*a* of the detecting unit 20, and the detecting unit 20 is switched to the first position. It is noted that when the cover 6 is completely closed, as shown in FIG. 15B, the upper face 8*a* of the pressing piece 8 of the cover 6 comes into contact with the lower face 56*b* of the pressed part 56 of the second movable member 32. Because the second movable member 32 is biased downwardly by the coil spring 61, the contact condition of the pressed part 56 of the second movable member 32 and the pressing piece 8 of the cover 6 is kept by this bias force. That is, the cover 6 is kept in the closed condition.

Further, because the locking piece 48 of the horizontal sliding member 34 is separated downwardly from the restricting piece 17 of the upper plate 13*c* of the container holder 13 as described above, as shown in FIG. 16B, the locking piece 48 passes through below the restricting piece 17.

Figure 17:
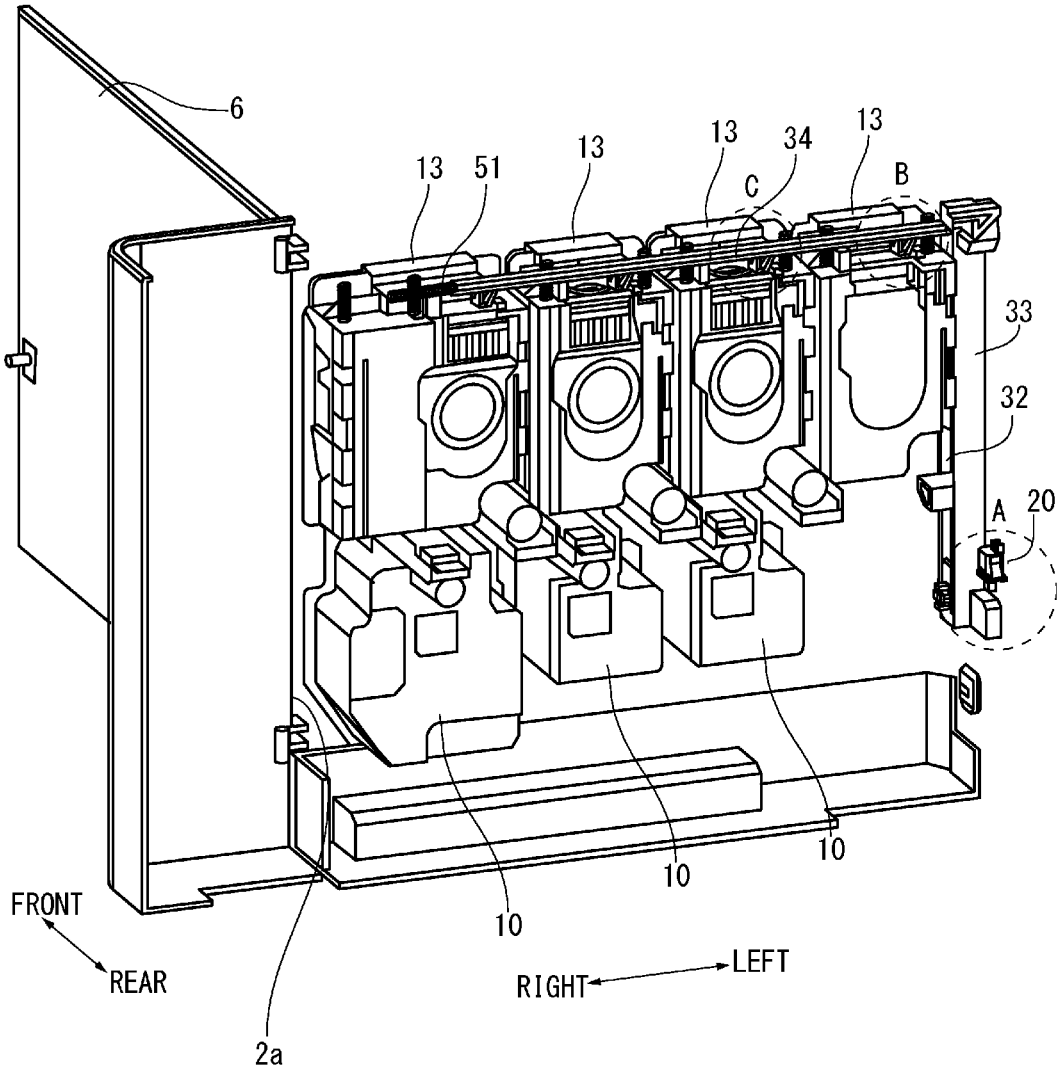
FIG. 17 is a perspective view illustrating the color printer, in a state that the toner container is not attached yet in one container holder and the cover is opened, viewed from the right rear side, according to the embodiment of the present disclosure.
Figure 18A:
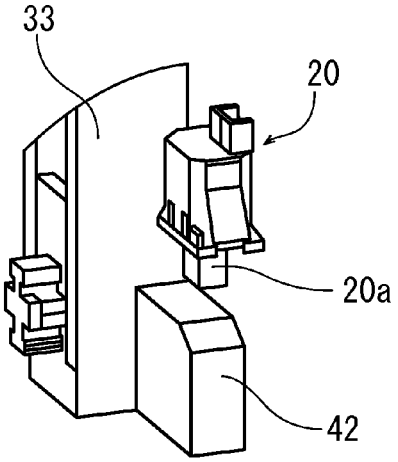
FIG. 18A is an enlarged view of a part A shown in FIG. 17.

As shown in FIG. 17, in a condition in which the toner container 10 is not attached to the left end container holder 13 and the cover 6 is opened, the horizontal sliding member 34 is biased by the coil spring 51 in the left direction, and the vertical sliding member 33 is biased downwardly. That is, as shown in FIG. 18A, the lower pressing part 42 of the vertical sliding member 33 is separated downwardly from the switching part 20*a* of the detecting unit 20 and the press of the detecting unit 20 is released.

Figure 18B:
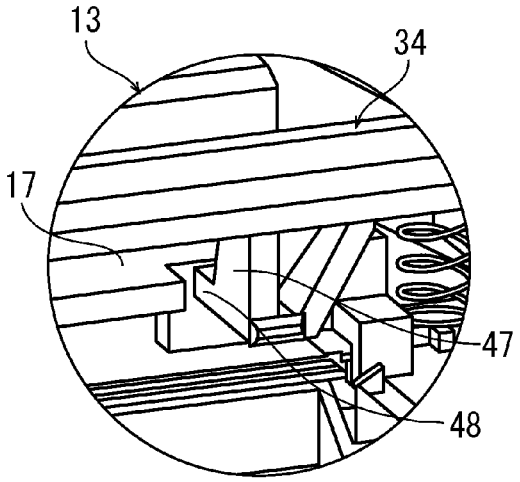
FIG. 18B is an enlarged view of a part B shown in FIG. 17
Figure 18C:
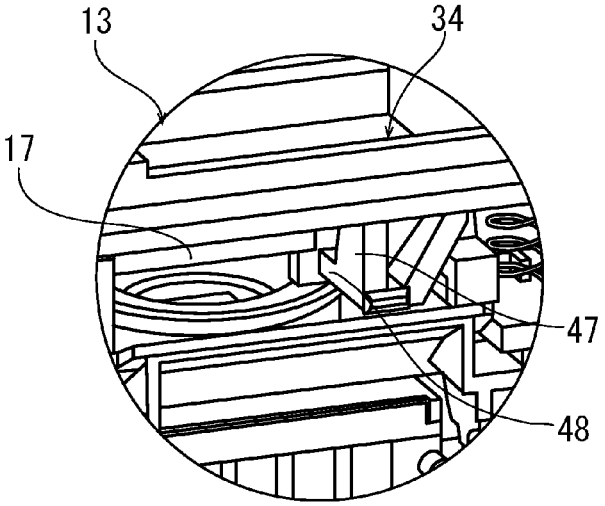
FIG. 18C is an enlarged view of a part C shown in FIG. 17.

In this condition, because the left end container holder 13 to which the toner container 10 is not attached yet is biased downwardly by the springs 19, as shown in FIG. 18B, the restricting piece 17 is lowered to almost the same level with the locking piece 48 of the horizontal sliding member 34. It is noted that, as shown in FIG. 18C, in the container holder 13 to which the toner container 10 is attached, the locking piece 48 of the horizontal sliding member 34 is separated downwardly from the restricting piece 17.

Figure 19:
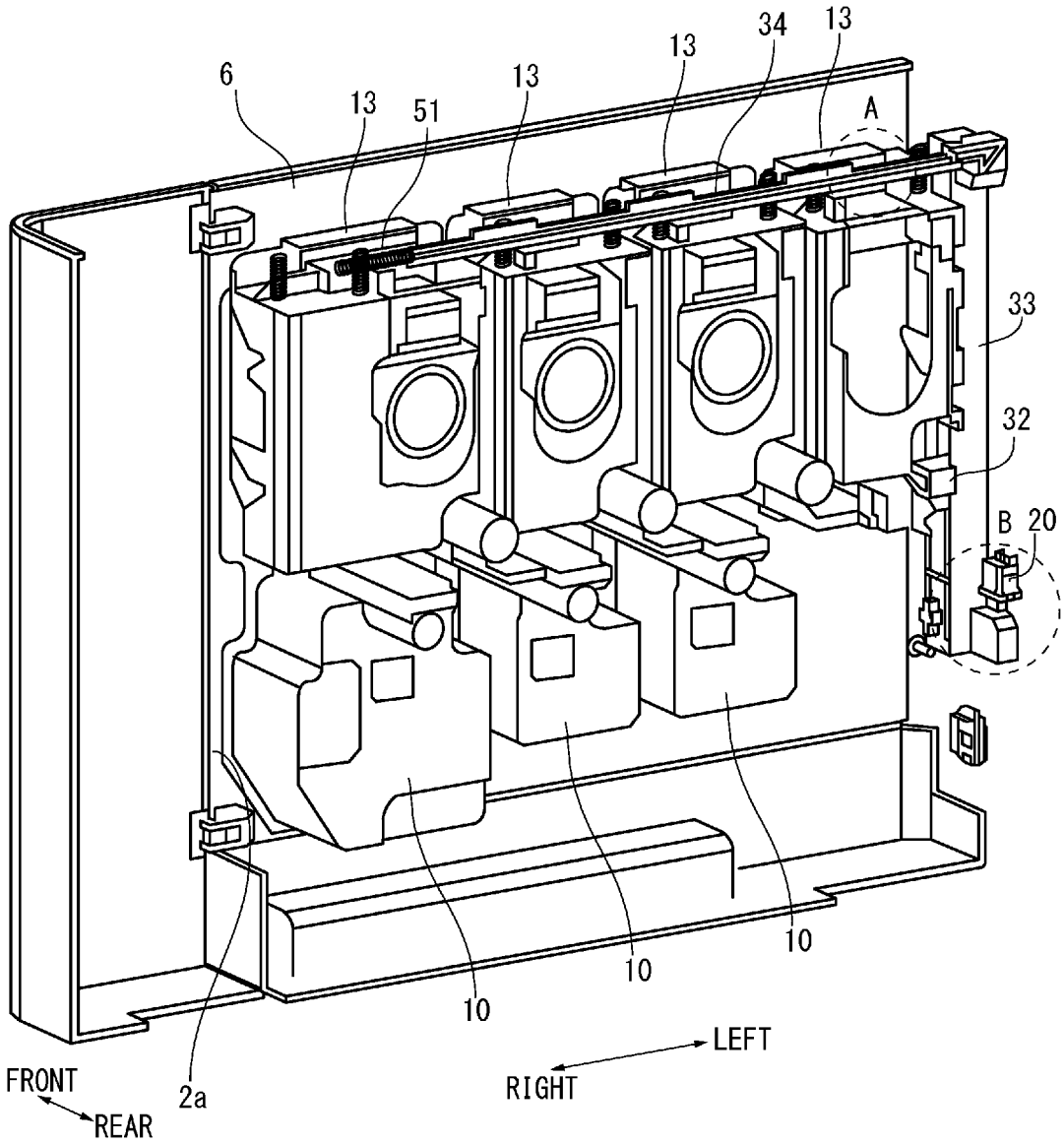
FIG. 19 is a perspective view illustrating the color printer, in a state that the toner container is not attached yet to one of the container holder and the cover is closed, viewed from the right rear side, according to the embodiment of the present disclosure.

As shown in FIG. 19, when the cover 6 is closed in the condition in which the toner container 10 is not attached yet to the left end container holder 13, the pressing piece 8 provided on the cover 6 presses the pressed part 56 of the second movable member 32 stored in the vertical sliding member 33, pushes up the vertical sliding member 33 together with the second movable member 32, and intends to slide the horizontal sliding member 34 in the right direction.

Figure 20A:
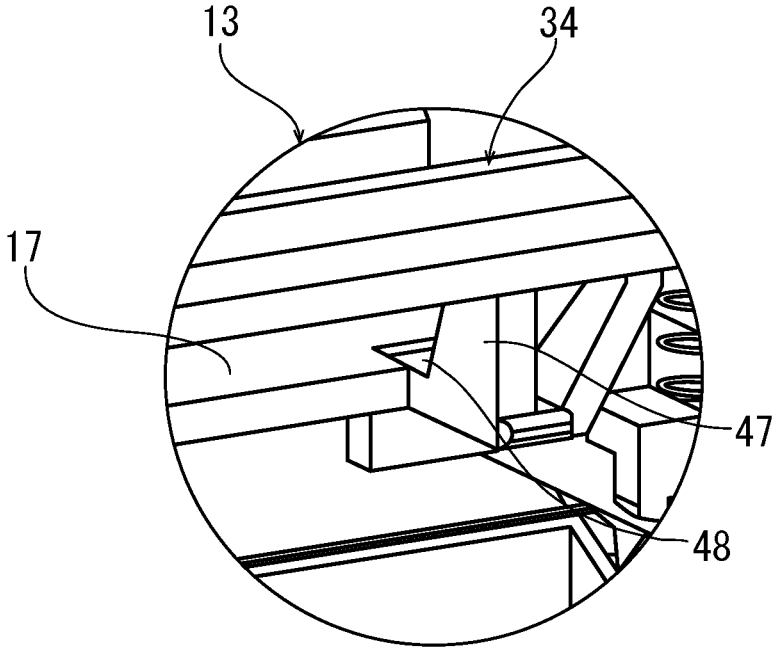
FIG. 20A is an enlarged view of a part A shown in FIG. 19
Figure 20B:
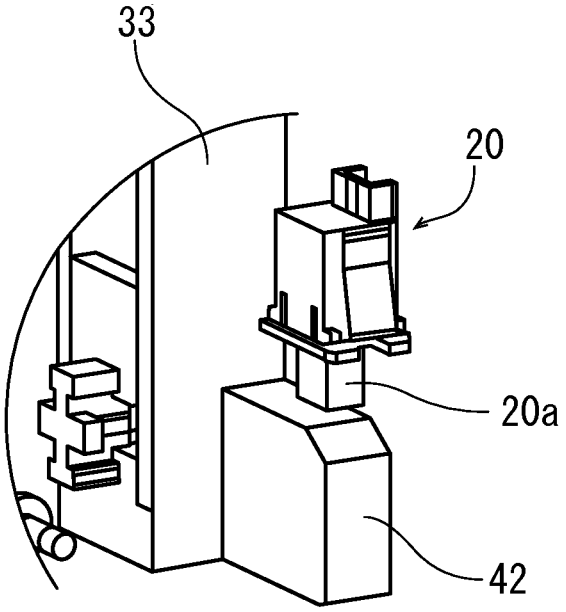
FIG. 20B is an enlarged view of a part B shown in FIG. 19.

However, in the left end container holder 13 to which the toner container 10 is not attached yet, as shown in FIG. 20A, the locking piece 48 of the horizontal sliding member 34 is locked by the restricting piece 17 of the container holder 13, and the horizontal sliding member 34 is restricted from sliding in the right direction. If the slide of the horizontal sliding member 34 is thus restricted, the upward slide of the vertical sliding member 33 is also restricted. Then, as shown in FIG. 20B, the switching part 20*a* of the detecting unit 20 is not pressed by the lower pressing part 42 of the vertical sliding member 33 and the detecting unit 20 is restricted from switching to the first position. That is, the movable member 30 is configured so that, if the cover 6 is closed in the condition in which the toner container 10 is not attached yet to the container holder 13, the move in the direction of switching the switching part 20*a* from the second position to the first position is restricted by the container holder 13.

However, even if the vertical sling member 33 is restricted from sliding upwardly, because the pressed part 56 of the second movable member 32 is pressed upwardly by the pressing piece 8 of the cover 6, the second movable member 32 slides upwardly relatively to the vertical sliding member 33 against the bias force of the coil spring 61. The second movable member 32 finally slides upwardly until when the upper face 8*a* of the pressing piece 8 of the cover 6 comes into contact with the lower face 56*b* of the pressed part 56 of the second movable member 32. Then, the contact condition of the pressed part 56 of the second movable member 32 and the pressing piece 8 of the cover 6 is kept by the coil spring 61, and the cover 6 is kept in the closed condition.

Thus, when the toner container 10 is not attached yet, even if the toner container attaching/detaching opening 2*a* is closed by the cover 6, the detecting unit 20 is not switched to the first position. That is, because information indicating that the toner container 10 is not attached yet to the container holder 13 is transmitted from the detecting unit 20 to the control part, the control part determines the image forming disabled state and executes no image forming operation.

As described above, according to the color printer 1 according to the embodiment of the present disclosure, it is possible to detect whether or not the toner container 10 is attached to the container holder 13 by one detecting unit 20 by interlocking with the closing operation of the cover 6 by the movable member 30 interlocking with the opening/closing operation of the cover 6. Accordingly, because it is not necessary to increase a number of sensors detecting opening/closing and others, it is possible to suppress an increase of the cost. Specifically, even in the case of having the plurality of toner containers 10 as the full-color image forming apparatus, it is possible to detect whether or not the toner containers 10 are attached by one detecting unit 20.

Specifically, even if the cover 6 is closed in the condition in which the toner container 10 is not attached yet, the detecting unit 20 cannot switch to the first position. In other words, it is configured such that, in the case when one of the toner containers 10 is not attached yet, the image forming operation of the image forming part is not carried out even if the cover 6 is closed. Accordingly, because no such situation in which the image forming operation is carried out without attaching the toner container 10, it is possible to prevent the malfunction of the photosensitive drum caused by the uncollected waste toner. Further, when the cover 6 is opened, the detecting unit 20 is switched to the second position. That is, because the control part determines the image forming disabled state, no hot swapping occurs even if the toner container 10 is detached.

Further, because the coil spring 61 is interposed between the first movable member 31 and the second movable member 32, when the slide of the first movable member 31 in the direction of switching the detecting unit 20 from the second position to the first position is restricted by the container holder 13, the slide of the second movable member 32 is absorbed by contraction of the coil spring 61. Accordingly, it is possible to close the cover 6 without switching the detecting unit 20 to the first position even if the toner container 10 is not attached yet. For instance, in a case when it is necessary to convey the color printer in the condition in which the toner container 10 is not attached yet for maintenance of the apparatus or the like, if the apparatus were configured such that the cover 6 cannot be closed while the toner container 10 is not attached, the cover 6 may be kept open and the apparatus may be hardly conveyed. However, according to the embodiment, since the cover 6 can be closed without switching the detecting unit 20 to the first position even if the toner container 10 is not attached, it becomes easy to handle the color printer 1.

Further, because the bias force of the coil spring biasing the second movable member 32 is set to be greater than the bias force of the coil spring 51 biasing the horizontal sliding member 34 in the left direction, the coil spring 51 biasing the horizontal sliding member 34 is preferentially contracted when the cover 6 is closed and the second movable member 32 is pressed and moved upwardly in the condition in which the toner container 10 is attached. Accordingly, it is possible to slide the vertical sliding member 33 in the direction of switching the detecting unit 20 from the second position to the first position together with the second movable member 32 against the biasing force of the coil spring 51. That is, the movable member 30 is configured so as to be allowed to move in the direction of switching the switching part 20*a* from the second position to the first position when the cover 6 is closed in the condition in which the toner container 10 is attached to the container holder 13.

Further, because the first movable member 31 is composed of the vertical sliding member 33 and the horizontal sliding member 34, it is possible to deal with the color printer 1 in which a plurality of toner containers 10 is arrayed in the left and right directions. Because the full-color image forming apparatus is often configured so as to array the toner containers 10 in the left and right directions, it is possible to obtain higher versatility. It is noted that in the case where the toner containers 10 are arrayed in the upward and downward directions, by arranging the container holder 13 so as to move in the left and right directions depending on whether or not the toner containers are attached, it is possible to construct the first movable member 31 only by the vertical sliding member 33.

It is noted while the push-type sensor has been used as the detecting unit 20 in the embodiment, it is also possible to use another sensor, such as an optical sensor or the like detecting position of the lower pressing part 42 of the vertical sliding member 33. Further, even if the push-type sensor is used, the switching part may be disposed upwardly or a switching part switched to the second position by being pressed and to the first position by being released from the press may be arranged.

Figure 21:
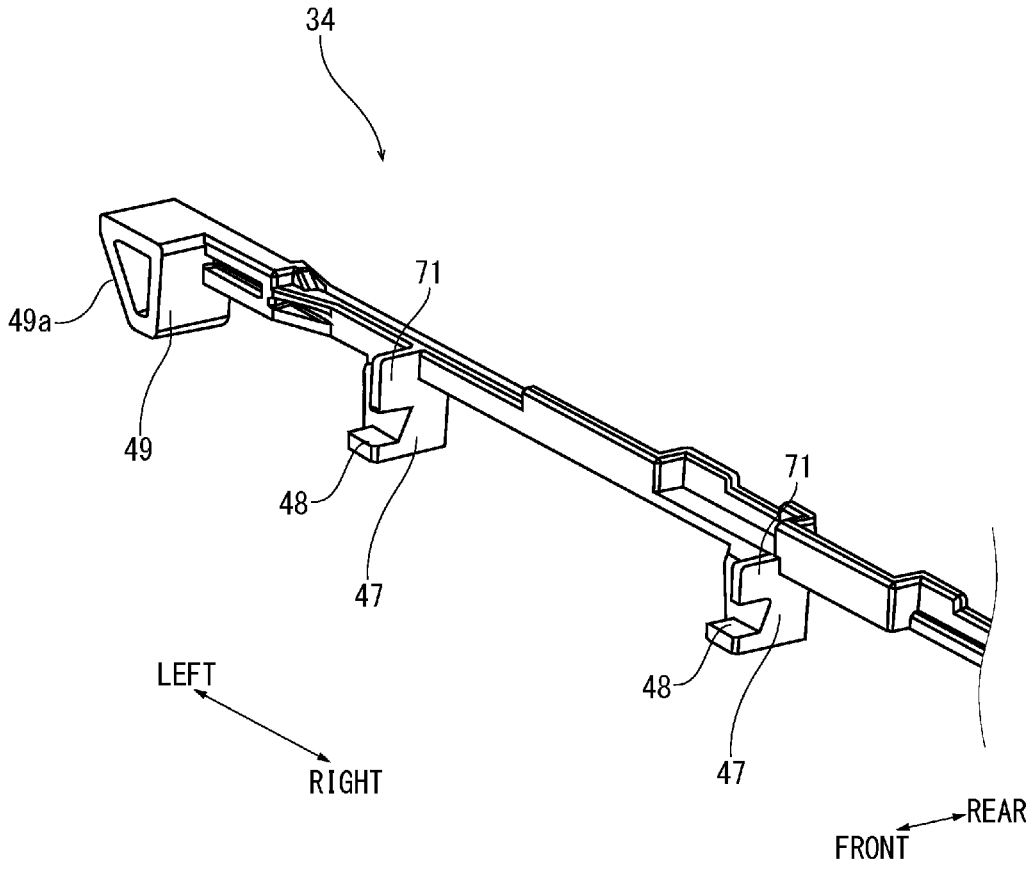
FIG. 21 is a perspective view illustrating a horizontal sliding member of a second example in the color printer according to the embodiment of the present disclosure.
Figure 22:
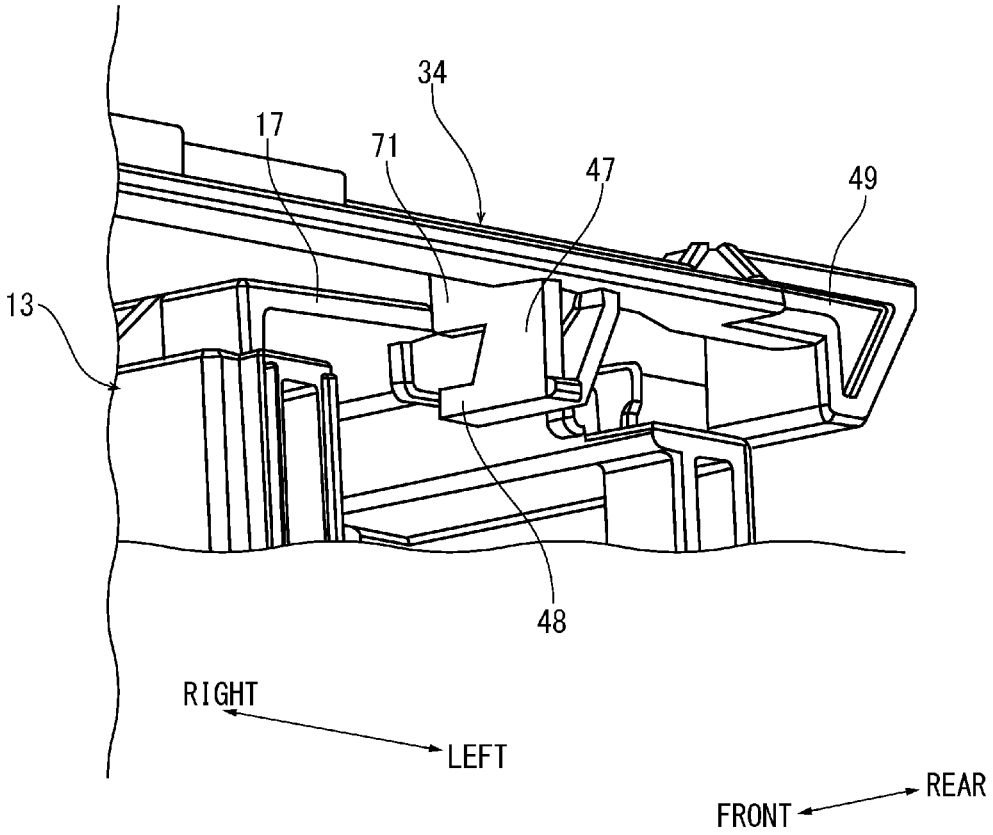
FIG. 22 is a perspective view illustrating the horizontal sliding member of the second example and the container holder, in a case where the toner container is attached halfway to the container holder, in the color printer according to the embodiment of the present disclosure.
Figure 23:
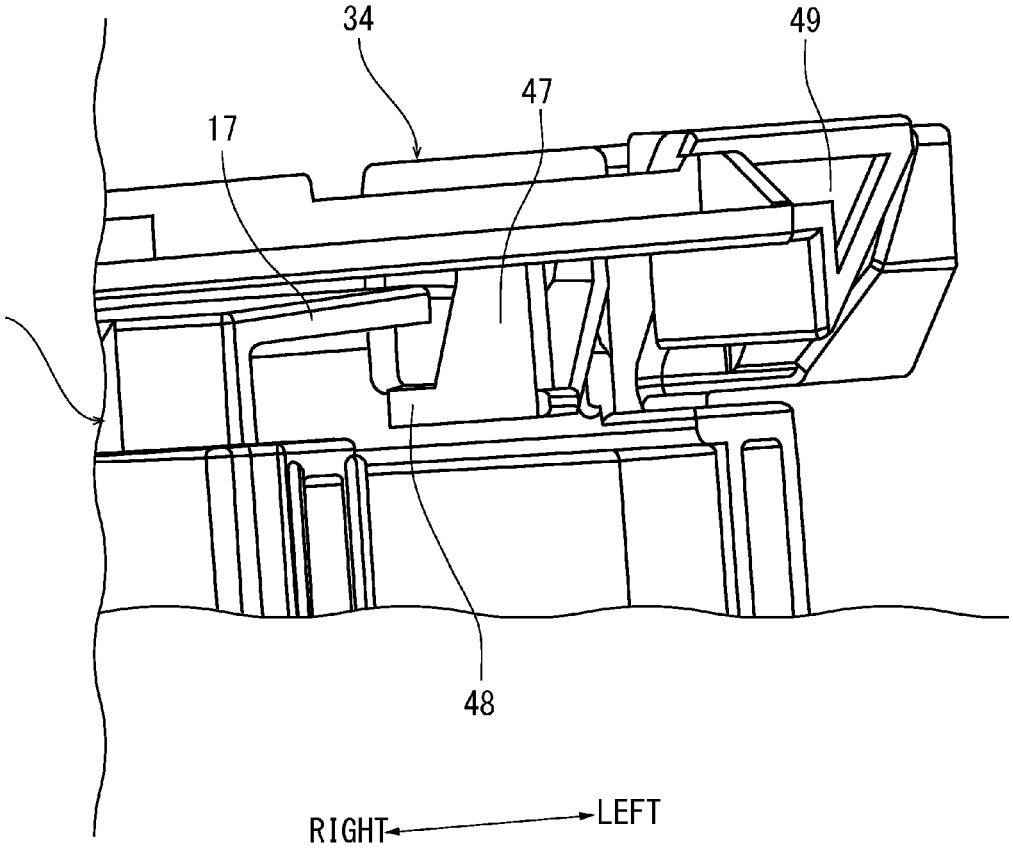
FIG. 23 is a perspective view illustrating the horizontal sliding member of the first example and the container holder, in the case where the toner container is attached halfway to the container holder, in the color printer according to the embodiment of the present disclosure.

Next, a second example of the horizontal sliding member 34 will be described with reference to FIGS. 21-23. FIG. 21 is a perspective view of the horizontal sliding member 34 of the second example, FIG. 22 is a perspective view illustrating the horizontal sliding member 34 and the container holder 13 of the second example in a case when the toner container is attached halfway to the container holder, and FIG. 23 is a perspective view illustrating the horizontal sliding member 34 and the container holder 13 of the first example in the case when the toner container is attached halfway to the container holder.

The horizontal sliding member 34 of the second example is provided with an auxiliary locking piece 71 in each project part 47 as shown in FIG. 21. The auxiliary locking piece 71 is formed into a plate-like shape thin in left and right directions and extends forwardly from a right end part of a front face of the project part 47 at an upper side separated from the locking piece 48 at a predetermined gap. The predetermined gap is, for example, a gap slightly longer than a thickness of the restricting piece 17 of the container holder 13.

As shown in FIG. 8, the toner container 10 is attached to the container holder 13 by engaging each boss 11 erected on each of the right and left side surfaces with the engagement part 16 after pushing the boss 11 along each inclined edge 15 formed of each of the right and left side plates 13*a* of the container holder 13. However, there may be a case when the toner container 10 is attached to the container holder 13 in a state in which each boss 11 is pushed in only halfway of the inclined edge 15. When the toner container 10 is thus attached halfway to the container holder 13, the container holder 13 moves upwardly more than the condition in which the toner container 10 is normally attached.

If the toner container 10 thus moves upwardly, while the locking piece 48 formed on each project part 47 of the horizontal sliding member 34 separates below the restricting piece 17, the auxiliary locking piece 71 faces to the restricting piece 17 in the left and right directions.

If the cover 6 is closed in the condition in which the toner container 10 is attached halfway to the container holder 13, a force in the right direction is applied to the vertical sliding member 33 through the vertical sliding member 33 as described above. However, in such a case when the toner container 10 is attached halfway to the container holder 13 and moves exceeding a predetermined position, as shown in FIG. 22, since the auxiliary locking piece 71 comes into contact with the restricting piece 17 of the container holder 13 in the horizontal sliding member 34 of the second example, the horizontal sliding member 34 is restricted from sliding. Accordingly, since the vertical sliding member 33 is restricted from sliding upwardly and the detecting unit 20 is not switched to the first position, it is possible to restrict the image forming operation without determining the image forming enabled state by the control part.

It is noted that in the case of the horizontal sliding member 34 of the first example, when the toner container 10 is attached halfway to the container holder and the container holder 13 moves downwardly (to a predetermined position in the upward and downward directions), as shown in FIG. 23, because the locking piece 48 is separated below the restricting piece 17, the horizontal sliding member 34 is allowed to slide and the vertical sliding member 33 also slides upwardly, and then, the detecting unit 20 may be switched to the first position. In such cases, troubles that no toner is replenished from the toner container 10 and the waste toner cannot be collected may occur. However, by applying the horizontal sliding member 34 of the second example, it is possible to prevent such troubles from occurring by restricting the horizontal sliding member 34 from sliding by the simple configuration.

The embodiment of the present disclosure was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the attachment mechanism of the optical scanning device and the image forming apparatus including this of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

a cover opening/closing an opening for attaching/detaching a toner container;

a container holder supported so as to be movable in a predetermined direction within the opening by attaching the toner container;

a detecting unit including a switching part switching a first position detecting an attaching condition of the toner container to the container holder and a second position detecting a not-attaching condition of the toner container to the container holder; and a movable member interlocking with an opening/closing operation of the cover and switching the switching part of the detecting unit by moving, wherein the movable member is allowed to move in a direction of switching the switching part from the second position to the first position when the cover is closed in the attaching condition of the toner container to the container holder, the movable member is further configured so that the move in the direction of switching the switching part from the second position to the first position is restricted by the container holder when the cover is closed in the not-attaching condition of the toner container to the container holder.

2. The image forming apparatus according to claim 1, wherein the movable member includes:

a first movable member switching the switching part of the detecting unit by sliding; and a second movable member being slidably supported by the first movable member and sliding by interlocking with the opening/closing operation of the cover;

wherein, between the first movable member and the second movable member, a first biasing member having a bias force in a direction opposite to a slide direction of the second movable member interlocking with a closing operation of the cover is interposed.

3. The image forming apparatus according to claim 2 further comprising:

a second biasing member biasing the first movable member in a direction of switching the switching part of the detecting unit from the second position to the first position, wherein the second biasing member has a bias force set to be greater than the bias force of the first biasing member.

4. The image forming apparatus according to claim 3, wherein the container holder is configured so as to move in upward and downward directions by attaching the toner container;

the first movable member includes:

a vertical sliding member switching the switching part of the detecting unit by sliding in the upward and downward directions; and a horizontal sliding member sliding in left and right directions in accordance with a slide of the vertical sliding member in the upward and downward directions and being biased in the left and right directions by the second biasing member, and accordingly, biasing the vertical sliding member in the direction of switching the switching part of the detecting unit from the first position to the second position, wherein a slide of the vertical sliding member in the direction of switching the switching part of the detecting unit from the second position to the first position is restricted by restricting the horizontal sliding member from sliding in the left and right directions by the container holder in the not-attaching condition of the toner container to the container holder.

5. The image forming apparatus according to claim 4, wherein the toner container and the horizontal sliding member respectively include a restricting piece and a locking piece disposed along a slide direction of the horizontal sliding member, the horizontal sliding member is restricted from sliding in the not-attaching condition of the toner container to the container holder by making the locking piece come into contact with the restricting piece, the restricting piece is separated from the locking piece in the upward and downward directions and the horizontal sliding member is allowed to slide in a condition in which the container holder is moved to a predetermined position in the upward and downward directions in the attaching condition of the toner container to the container holder.

6. The image forming apparatus according to claim 5, wherein the horizontal sliding member includes an auxiliary locking piece separated from the locking piece at a predetermined gap in a moving direction of the container holder in attaching the toner container, the horizontal sliding member is restricted from sliding by making the auxiliary locking piece come into contact with the restricting piece in a condition in which the toner container is moved to a position separated from the predetermined position in the moving direction.

* * * * *